US008128867B2

(12) United States Patent
Iwasaki et al.

(10) Patent No.: US 8,128,867 B2
(45) Date of Patent: Mar. 6, 2012

(54) HIGH STRENGTH HARD ALLOY AND METHOD OF PREPARING THE SAME

(75) Inventors: Masahiro Iwasaki, Himeji (JP); Hidefumi Yanagita, Himeji (JP); Masaaki Ikebe, Himeji (JP)

(73) Assignee: Sanalloy Industry Co., Ltd., Hyogo (JP)

( * ) Notice: Subject to any disclaimer, the term of this patent is extended or adjusted under 35 U.S.C. 154(b) by 0 days.

(21) Appl. No.: 12/983,561

(22) Filed: Jan. 3, 2011

(65) Prior Publication Data

US 2011/0109020 A1 May 12, 2011

Related U.S. Application Data

(62) Division of application No. 11/518,519, filed on Sep. 11, 2006, now Pat. No. 7,887,747.

(30) Foreign Application Priority Data

Sep. 12, 2005 (JP) ..... 2005-263560

(51) Int. Cl.
*C22C 29/02* (2006.01)
*C22C 1/05* (2006.01)
*C22C 1/04* (2006.01)

(52) U.S. Cl. ..... 419/15; 75/241; 419/47

(58) Field of Classification Search ..... 75/300, 75/228, 230, 236–248, 392, 414, 626, 746–773, 75/950, 956; 148/95, 206, 207, 210–212, 148/218, 219, 223, 237, 278, 279, 280, 513, 148/516, 559, 668, 674, 708, 902; 419/10–18, 419/26, 29, 45, 46, 47, 53–55
See application file for complete search history.

(56) References Cited

U.S. PATENT DOCUMENTS 3,531,280 A 9/1970 Iler et al.
(Continued)

FOREIGN PATENT DOCUMENTS

GB 1134022 A 11/1968
(Continued)

OTHER PUBLICATIONS

Tandon, Rajiv, and John Johnson, "Liquid-Phase Sintering," vol. 7, ASM Handbooks Online, ASM International, 2002.
Ellis, John L. and Claus G. Goetzel, "Powder Metallurgy Cermets and Cemented Carbides," adapted from vol. 2 of ASM Handbook, 1990. pp. 978-1007 (vol. 2).
(Continued)

*Primary Examiner* — Scott Kastler
*Assistant Examiner* — Vanessa Luk
(74) *Attorney, Agent, or Firm* — Westerman, Hattori, Daniels & Adrian, LLP

(57) ABSTRACT

A method for producing a cemented carbide material includes producing an $M_3C$ type double carbide (wherein M comprises M1 and M2; M1 represents one or more elements selected from the group consisting of Ti, Zr, Hf, V, Nb, Ta, Cr, Mo, and W; and M2 represents one or more elements selected from the group consisting of Fe, Co and Ni) as a main component of the surface portion; reducing heat treating the compact at a vacuum atmosphere; carburizing the resulting WC—Co compact at a temperature of 800 to 1100° C.; subjecting the carburized compact to liquid phase sintering at a temperature of more than 1350° C. to form a sintered body; and coating a surface layer of the sintered body with a compound containing boron and/or silicon and subjecting the coated sintered body to a diffusion heat treatment at a temperature within a range from 1200 to 1350° C.

9 Claims, 11 Drawing Sheets

U.S. PATENT DOCUMENTS

| | | | | |
|---|---|---|---|---|
| 4,097,275 | A | | 6/1978 | Horvath |
| 4,743,515 | A | | 5/1988 | Fischer et al. |
| 4,895,770 | A | | 1/1990 | Schintlmeister et al. |
| 5,918,103 | A | * | 6/1999 | Kobayashi et al. ..... 419/18 |
| 5,945,167 | A | | 8/1999 | Kuwabara et al. |
| 6,024,776 | A | | 2/2000 | Heinrich et al. |
| 6,056,999 | A | | 5/2000 | Narasimhan |

FOREIGN PATENT DOCUMENTS

| | | | |
|---|---|---|---|
| JP | 47-023049 | A | 6/1972 |
| JP | 2-274827 | A | 11/1990 |
| JP | 4-128330 | A | 4/1992 |
| JP | 8-127807 | A | 5/1996 |
| JP | 2002-249843 | A | 9/2002 |

OTHER PUBLICATIONS

Sinha, Anil Kumar, "Boriding (Boronizing) of Steels," vol. 4, ASM Handbooks Online, 2002.

Callister, Jr., William D., Materials Science and Engineering, An Introduction, 6th edition, John Wiley & Sons. pp. 100-102, 777. (copyright 2003).

Upadhyaya, Gopal S., Cemented Tungsten Carbides: Production. Properties, Testing, Noyes Publications, chapters 6 and 15, 1998.

Pierson, Hugh O. "Handbook of Chemical Vapor Deposition (CVD): Principles, Technology, and Applications," Second Edition, Noyes Publications, 1999. (Ch. 8—CVD of Non-metallic Elements).

* cited by examiner

Schematic view of chemical vapor deposition (CVD)

HIGH STRENGTH HARD ALLOY AND METHOD OF PREPARING THE SAME

CROSS-REFERENCE TO RELATED APPLICATIONS

This application is a divisional of U.S. application Ser. No. 11/518,519, filed on Sep. 11, 2006, which is based on and claims priority from Japanese Patent Application No. 2005-263560, filed on Sep. 12, 2005, the entire contents of which being incorporated herein by reference.

BACKGROUND OF THE INVENTION

1. Field of the Invention

The present invention relates to a WC—Co system cemented carbide having high strength and high toughness and is excellent in wear resistance, toughness, chipping resistance and thermal crack resistance, and is also applied for tools for cold forging, rolls, bits for mining tool, crushing blades, cutter blades and wear resistant tools. The WC—Co system in the present invention means that it comprises not only hard grains composed mainly of WC and iron group metal powder containing Co, but also at least one kind selected from the group consisting of carbide, nitride, carbonitride and boride of elements in Groups IVa, Va and VIa of the Periodic Table, excluding WC, as hard grains.

2. Description of the Related Art

A commercially available wear resistant cemented carbide is a composite material of a WC hard phase and a Co metal phase, and is a typical one of a dispersion type alloy. Mechanical properties thereof depend on the grain size of the WC hard phase and the amount of a Co binder metal phase and, particularly, hardness and toughness are antinomic with each other. To fully make use of extremely excellent hardness of the cemented carbide, various proposals have been made on a cemented carbide having high strength and high toughness.

For example, Japanese Examined Patent Publication (Kokoku) No. 47-23049 discloses a high strength alloy comprising tungsten carbide plate-shaped grains having unequal sizes, wherein a maximum size is 50 μm or less and the maximum size is at least three times larger than a minimum size, and Fe group metal. However, the plate-shaped tungsten carbide having unequal sizes is hardly applied for various wear resistant cemented carbide products which require a near net shape because an oriented WC grain growth structure is obtained by applying a shear force through rolling while heating using a fine tungsten carbide as a starting material.

Furthermore, Japanese Unexamined Patent Publication (Kokai) No. 02-274827 relates to a technology for manufacturing an anisotropic cemented carbide compact having excellent crack propagation resistance or toughness and describes a method comprising the steps of oxidizing a cemented carbide, which has already sintered, followed by reduction and further carbonization to obtain a WC—Co mixed powder having anisotropy. However, it is a method using the used cemented carbide after regeneration and a leased facility is required, and therefore it is difficult to cope with such a problem.

These inventions relate to a method for producing a cemented carbide having high hardness and high toughness, which has entirely uniform structure, by employing a specific grain form such as anisotropy WC grains or plate crystal tungsten carbide as a hard phase. On the other hand, a method for producing a high strength cemented carbide as a composite material is also proposed.

Japanese Unexamined Patent Publication (Kokai) No. 08-127807 discloses a gradient composite material comprising the surface layer portion having a ceramic grain growth structure and the interior enriched with a metal phase, which is produced by impregnating with a grain growth accelerator from the surface of a compact and firing the compact after drying.

Furthermore, Japanese Patent Unexamined Publication (Kokai) No. 2002-249843 discloses that a composite material having high hardness, high strength and high toughness, which has a grain growth structure and a three-dimensional network structure in the surface layer portion, is obtained by forming a mixed powder of non-oxide ceramic grains and metal grains into a compact, and coating the surface of the compact with a boron compound-containing solution, followed by sintering. However, these proposals only make mention of toughening due to a rain growth structure of the surface layer portion and do not make mention of the fact that the grain size of the surface layer portion is decreased versus that of the inner portion.

On the other hand, Japanese Unexamined Patent Publication (Kokai) No. 04-128330 proposes a sintered alloy having gradient composition structure wherein the concentration of a binder phase gradually increases from the surface to the interior and also the mean grain size of a hard phase gradually increases, which is produce by coating a pressed compact made of a sintered alloy comprising a hard layer composed mainly of a metal carbide and a binder layer made of a ferrous metal before sintering with various diffusion elements, and subjecting to liquid phase sintering thereby reacting the diffusion element with the binder layer on the surface of the hard phase.

[Patent Document 1] Japanese Examined Patent Publication (Kokoku) No. 47-23049

[Patent Document 2] Japanese Unexamined Patent Publication (Kokai) No. 02-274827

[Patent Document 3] Japanese Unexamined Patent Publication (Kokai) No. 08-127807

[Patent Document 4] Japanese Patent Unexamined Publication (Kokai) No. 2002-249843

[Patent Document 5] Japanese Unexamined Patent Publication (Kokai) No. 04-128330

SUMMARY OF THE INVENTION

Since the shape of a cutting and turning tip as a main application of a cemented carbide is decided by die molding, the above described plate crystal WC and anisotropic WC are applied very easily, however, it is very hard to apply for a wear resistant cemented carbide product having a complicated shape produced by various molding forming technologies. Also a sintered alloy having a gradient composition structure, which has conventionally been proposed, is not suited for practical use because it shows comparatively small difference in concentration of a binder layer from the surface layer to the interior and a small rate of increase in the mean grain size of a hard phase, and also fracture toughness of the surface layer is not remarkably improved and cavities are formed in the structure.

Therefore, the present inventors have intensively studied for the purpose of providing a product having a complicated shape with a composite structure comprising a surface layer having high hardness and high toughness and an interior having a high strength, and found that grain size gradient of hard grains and concentration gradient of a binder layer can be controlled with good accuracy by separately controlling grain size gradient of hard grains and concentration gradient of the binder layer without controlling simultaneously them, and thus the present invention provides a desired ultrahard material.

The present inventors have intensively studied in light of the fact an ideal high toughness cemented carbide must comprises the surface layer portion having a skeletal structure made of coarse hard grains with a small amount of a binder metal, and the interior having a grain dispersed structure made of fine hard grains with a large amount of a binder metal, while an ideal high strength cemented carbide comprises the surface layer portion having a skeletal structure made of ultrafine and fine hard grains with a small amount of a binder metal, and the interior having a grain dispersed structure made of fine hard grains with a large amount of a binder metal. Thus, the present invention has been completed.

Namely, a first invention provides a method for producing a cemented carbide material, comprising the steps of subjecting a WC—Co system compact containing an $M_{12}C$ to $M_3C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion to a carburization treatment, subjecting to liquid phase sintering, and adjusting the mean grain size of the surface layer WC using a liquid crystal sintering temperature as an indicator.

According to the present invention, fine grains of the surface layer portion obtained by sintering using the same starting material and using a liquid phase sintering temperature as an indicator are converted into ultrafine grains or coarse grains, and a double carbide with the composition of $M_{12}C$ to $M_3C$ is formed in the surface layer portion of the compact and is then decomposed by subjecting to a carburization treatment to form very fine and active WC grains. Therefore, it is possible to form fine WC grains having the grain size, which is 0.3 to 0.7 times smaller than that of the inner portion and coarse WC grains having the grain size, which is 1.5 to 10 times larger than that of the inner portion, on the surface layer portion of the sintered body using a liquid crystal sintering temperature as an indicator in final liquid phase sintering.

Furthermore, the present inventors have intensively studied for the purpose of improving the hardness of the surface layer portion and imparting compressive residual stress and found that a high strength cemented carbide comprising the surface layer portion having a low friction coefficient, which is extremely toughened by gradient of the concentration from the surface layer portion to an interior binder phase, can be obtained by coating the surface layer portion of the sintered body with boride or silicide and subjecting to a diffusion heat treatment at a temperature within a range from 1,200 to 1,350° C., which is lower than a liquid phase sintering temperature. Therefore, a second invention provides a method for producing a high strength cemented carbide, comprising the steps of coating the surface of a sintered body, which is obtained by liquid phase sintering of a WC—Co system compact containing an $M_{12}C$ to $M_3C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion, with a compound containing boron or silicon as a melting point depression element and subjecting to a diffusion heat treatment at a temperature within a range from 1,200 to 1,350° C., which is lower than a liquid phase sintering temperature. According to the second invention, it is possible to obtain a high strength cemented carbide sintered material for a WC—Co system compact containing an $M_{12}C$ to $M_3C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion containing boron B or silicon Si in an amount within a range from 0.010 to 1.0% by weight, the surface layer portion comprises hard grains having higher distribution density than that of the interior.

A third invention is a combination of the first invention and the second invention and provides a cemented carbide material having grain size gradient of hard grains and concentration gradient of a binder phase from the surface layer portion to the interior, and is characterized by subjecting a WC—Co system compact containing an $M_{12}C$ to $M_3C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion to a carburization treatment, subjecting to liquid phase sintering to obtain a sintered body, coating the surface of the sintered body with a compound containing boron or silicon as a melting point depression element, and subjecting again to a diffusion heat treatment at a temperature within a range from 1,200 to 1,350° C., which is lower than a liquid phase sintering temperature. According to the third invention, it is possible to obtain a high strength cemented carbide sintered tool having excellent mechanical properties made of a WC—Co system sintered body containing an $M_{12}C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion, the cemented carbide sintered tool having structure gradient wherein a mean grain size of the surface layer portion WC is 0.3 to 0.7 times smaller than that of the inner portion, concentration gradient wherein a binder metal of the surface layer portion transfers to the interior side, hardness of the surface layer portion hardness HRA of 91 to 95, and toughness $K_{IC}$ of 15 to 23 $MN/m^{3/2}$. It is also possible to obtain a high strength cemented carbide sintered tool having excellent mechanical properties made of a WC—Co system sintered body containing an $M_{12}C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion, the cemented carbide sintered tool having structure gradient wherein a mean grain size of the surface layer portion WC is 1.5 times or more larger than that of the inner portion, concentration gradient wherein a binder metal of the surface layer portion transfers to the interior side, hardness of the surface layer portion hardness HRA of 88 to 92, and toughness $K_{IC}$ of 20 to 30 $MN/m^{3/2}$.

As described above, according to the present invention, it is possible to provide a sintered tool having a hybrid structure wherein the surface layer portion and inner portion substantially differ in characteristics, and the sintered tool is excellent in hardness, wear resistance, toughness, chipping resistance and thermal crack resistance of the resulting cemented carbide.

According to the present invention, it is possible to provide a high toughness cemented carbide wherein the surface to be machined is formed of coarse hard grains, and to provide a high hardness cemented carbide wherein the surface to be machined is formed of fine hard grains for cutter blades, progressive dies and drawing tools. In addition, the cemented carbide can be applied for tools for cold, warm and hot forging, canning tools, rolls, bits for mining tool, crushing blades, cutter blades and wear resistant tools.

BRIEF DESCRIPTION OF THE DRAWINGS

FIG. 4(A) shows the inner portion and FIG. 4(B) shows the surface layer portion, respectively.

FIG. 5(A) shows the inner portion and FIG. 5(B) shows the surface layer portion, respectively.

DETAILED DESCRIPTION OF THE INVENTION

First Embodiment

Figure 1:
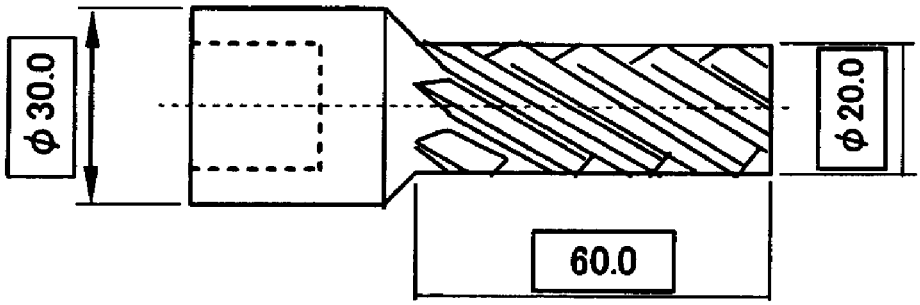
FIG. 1 is a front view showing a helical gear wherein the screw portion has a gentle spiral shape.

The present invention can be widely applied for a WC—Co system compact containing an $M_{12}C$ to $M_3C$ type double carbide (M represents one or more kinds selected from the group consisting of Ti, Zr, Hf, V, Nb, Ta, Cr, Mo and W, and one or more kinds selected from the group consisting of Fe, Co and Ni) as a main component of the surface layer portion. In the following embodiments, a WC—Co system sintered body will be mainly described.

First, a WC powder, a Co powder and other additive powders are milled to form a uniformly dispersed mixed powder, and then wax as a lubricant is added to obtain a raw material.

This raw material is compressed into a compact having a predetermined size and shape, presintered for the purpose of dewaxing and then formed into a near-net shaped compact having a predetermined size and shape. This compact has porosity of 30 to 50 vol %.

In the following step, a double carbide phase having the following phase form is formed in the surface layer portion of the compact in a volume rate of 50 vol % or more and a depth within a range from 3 to 5 mm from the surface. $M_{12}C$ [$Co_6W_6C$], $M_6C$ [$Co_3W_3C$, $Co_2W_4C$] and $M_3C$ [$Co_3W_9C_4$] (a Co element may be replaced by a Fe or Ni element, and W may be a solid solution with Ti and Ta).

The method for forming the double carbide includes various methods. For example, a double carbide phase is formed by oxidizing the surface layer with various acids and heat-treating thereby causing the self-reduction reaction, or a double carbide is similarly formed by adsorbing W ions in the surface layer portion using a W salt solution, followed by a heat treatment. Furthermore, a double carbide is formed by depositing chloride on the surface layer portion, followed by a heat treatment. Apart from these methods, to sum up, the composition of the surface layer portion may be within a WC-γ-η three-phase region of a Co—W—C ternary phase diagram. Formation of a $M_{12}C$ double carbide phase is required for refining of surface layer portion grains of the final sintered body, and formation of a $M_3C$ double carbide phase is required for grain coarsening.

Then, the double carbide phase is decomposed by subjecting to a carburizing heat treatment to form a fine and active WC phase. The double carbide phase is decomposed into two WC and Co phases by supplying carbon (C) to the double carbide phase at a temperature within a range from 600 to 1,100° C., and thus ultrafine WC grains are obtained.

The carburization treatment of the $M_{12}C$ double carbide phase must be performed at lower temperature and the carburization treatment of the $M_3C$ double carbide phase must be performed at higher temperature.

In this stage, a nitriding heat treatment can also be performed. It is very difficult to nitride conventional WC grains. However, the nitriding reaction of fine and active WC grains produced on decomposition of the double carbide phase is regarded nearly identical with the carburization, and WCN and WN can be easily formed within the same temperature range, in addition to WC and Co.

Finally, liquid phase sintering is performed at a temperature within a range from 1,300 to 1,500° C. and the grain size of WC grains of the surface layer portion is controlled. Refining of the WC grains is performed by sintering at low temperature of 1,350° C., and grain coarsening is performed by sintering at high temperature range of 1400° C. or higher. The fine and active WC phase is crystallized by sintering at low temperature of 1,350° C., thereby causing nucleation, and thus grain growth nucleus increases together with unmelted WC grains of a base phase. As a result, fine WC grains having a grain size smaller than that of fine WC grains of the inner portion are produced in the surface layer portion.

At the sintering at high temperature of 1,400° C. or higher, a very fine and active WC phase is preferentially melted based on the Ostwald growth on liquid phase sintering, resulting in grain growth.

The degree of grain growth is influenced by the composition of the double carbide and tendency of grain growth increases as the amount of combined carbon increases.

[Tendency of grain growth] $M_{12}C<M_6C<M_3C$

In the composite material thus obtained, the depth of the grain size control range of the surface layer portion is within a range from 0.5 to 4.5 mm. The grain size is 0.3 to 0.7 times larger than the inner grain size in case of microfine grains and the grain size is 1.5 to 10 times larger in case of coarse grains.

Regarding the amount of a binder metal, hardness of the surface layer portion whose grain size was controlled is almost the same as that of the inner portion because of a metallurgic action which controls the distance between WC grains to a given value.

In the additional step, when the surface of the resulting sintered body material is coated with a powder of a boron compound or a silicon compound and then subjected to a diffusion heat treatment at a temperature within a range from 1,200 to 1,350° C., the binder metal of the surface layer portion is reacted with boron or silicon thereby converting into a liquid phase, and also boron or silicon diffuses into the solid phase at the interface between the solid phase binder metal and the liquid phase. Therefore, conversion of the solid phase into a liquid phase proceeds and the liquid phase moves to the interior. Thus, the amount of the binder metal in the surface layer portion remarkably decreases to obtain a structure enriched with metal in the interior.

Finally, mechanical properties such as high hardness and high toughness, for example, hardness of the surface layer portion HRA of 88 to 95 and toughness $K_{IC}$ of 15 to 30 $MN/m^{3/2}$ are imparted and mechanical properties such as high strength is imparted to the interior. Furthermore, since compressive residual stress is applied in the surface layer portion region, the resulting product is best suited for use as various forging tools, pressing tools and mining tools wherein high load stress is applied on the surface.

The present invention will be described by way of a die for helical gear of a cold forging die, and digging tool cutter bit as an example.

Example 1

Trial Manufacture of Die for Helical Gear

A helical gear comprises the screw portion having a gentle spiral shape, as shown in FIG. 1, and is typically used in an automobile pinion shaft. The helical gear has conventionally been produced by cutting but has recently been producing by cold forging. However, since forging and molding are performed under very high pressure, burning or cracking occurs at the gear tooth portion of a mold in an early stage, resulting in very short lifetime. To solve such a problem, we are intended to apply an alloy of the present invention.

1) Trial Manufacture of Raw Material

30 Kg of a weighed raw material with the base composition of WC-15% Co (C/WC=4.0%) is prepared using a 1.5μ WC powder and a 1.1μ Co powder, subjected to atriter milling using an alcohol solvent for 30 hours, kneaded with a paraffin wax and then subjected to granulation and screening to obtain a completed powder.

Press Molding

To obtain a final sintering material dimension ϕ55×115 L, press molding (coefficient of linear contraction F=1.25) is performed to form a compact measuring ϕ75×170 L.

Primary Presintering

Dewaxing was carried out under an $N_2$ carrier gas atmosphere at a temperature within a range from 350 to 400° C. and presintering was carried out by a heat treatment under a vacuum atmosphere at a temperature within a range from 850 to 900° C. for 2 hours. Under this temperature condition, no contraction behavior arises.

Forming

A working size was calculated by calculating a contraction ratio of a presintered body with high accuracy and the presintered body was formed into a compact having a size, which is about 1.25 times larger than that of a sintered material shown in a schematic view, using an NC lathe.

Secondary Presintering

To improve the strength of the compact, the compact was presintered under a vacuum atmosphere at 1,100° C. for one hour.

Dipping Treatment

As a solution having the function of supplying both of W and an oxidizing agent, an aqueous 40% solution of tungstic acid ($H_2WO_4$) was used. A dipping treatment was performed by the following procedure. A stainless steel tray having the size enough to contain a compact was filled with an impregnating solution so as to sufficiently impregnate the compact with the solution, and then the compact is dipped for 30 seconds. After the dipping treatment, the compact is taken out and then immediately dried by a dryer at a temperature of 120° C.

Reducing Heat Treatment

In this example, a heat treatment was performed under a vacuum atmosphere at 1,000° C. for 2 hours. The X-ray diffraction due to T.P revealed a double carbide of two phases $Co_6W_6C$ [$M_{12}C$] and $Co_3W_3C$ [$M_6C$], in addition to a WC, Co phase, in the surface layer portion.

To obtain a grain refined structure by final liquid phase sintering, the presence of an $M_{12}C$ type double carbide phase is essential and the reducing heat treatment temperature is within a range from 900 to 1,100° C.

Carburizing Heat Treatment

By supplying a carburizing gas in a furnace within a predetermined temperature range, the double carbide phase produced in the impregnated region is decomposed to produce a very fine WC, Co phase.

Preferable carburization temperature is within a range from 600 to 900° C. The carburization was performed at a temperature of 900° C. for 30 minutes at a $CO+H_2$ gas flow rate of 20 ml/min in this example. The gas to be used may be a carburizing gas and the temperature range corresponds to a solid phase region of W—C—Co, and therefore phase transformation into WC+Co from the double carbide is performed extremely stably and easily.

When the treating temperature is higher than 1,100° C., solid solution of carbon into a Co phase proceeds, a possibility of generation of free carbon in an alloy structure during liquid phase sintering increases.

Process of Nitriding Treatment

In the above process, a nitriding heat treatment can also be carried out. By subjecting the produced double carbide phase to $N_2$ and $N_2+NH_3$ gas nitriding treatments, very fine WCN, WN phase can be produced by decomposition of the double carbide phase, in addition to the WC, Co phase.

The nitriding is preferably performed at a temperature of 800 to 1000° C. for 1 to 3 hours at a gas flow rate of about 20 to 100 ml/min. In the following liquid phase sintering, a partial pressure in a furnace of normal pressure or less may be maintained so as to prevent $N_2$ degassing from the material. As a result, grown grains have a core structure wherein the interior is made of WC and the growth portion is made of WCN or WN, and are extremely excellent in heat resistance.

Liquid Phase Sintering

A treatment was performed in a vacuum sintering furnace at a temperature of 1350° C. for 1.5 hours. During sintering at low temperature of 1,350° C., the fine and active WC phase is crystallized, thereby causing nucleation, and thus grain growth nucleus increases together with unmelted WC grains of a base phase. As a result, fine WC grains having a grain size smaller than that of fine WC grains of the inner portion are produced in the surface layer portion. As a result of structure observation, a refined structure having a grain size of 0.5 to 1.0 μm could be confirmed in the surface layer portion including the inside diameter surface.

Coating with Boron Compound

The inside diameter surface of the sintered body material thus obtained is coated with an alcohol slurry having a BN concentration of 20% and then dried by a dryer set at a temperature of 40° C. for one hour.

Diffusion Heat Treatment

After coating and drying, the material is subjected to a diffusion heat treatment at 1,300° C. for 2 hours. Since concentration gradient of boride is formed from the surface to the interior, the liquid phase of the surface layer portion continuously diffuses into the interior. Finally, the binder metal is scarcely remained in the surface layer portion region and a metal-rich structure is formed in the interior.

Mechanical properties of the developed alloy thus obtained are roughly classified into the followings in case of the surface layer portion and the interior.

TABLE 1

| Portion | Specific gravity g/cm$^3$ | Hardness HRA | Fracture toughness MN/m$^{3/2}$ |
|---|---|---|---|
| Surface portion of developed alloy | 15.05 | 92.2 | 22.4 |
| Inner portion of developed alloy | 14.03 | 87.3 | 19.5 |
| Comparative alloy WC—11Co | 14.50 | 89.2 | 14.1 |

Production of Comparative Alloy

For a comparison with this developed alloy, a cemented carbide material having the same size and shape was produced using a 1.5μ WC based WC-11% Co alloy by the following procedure. The WC-11% Co mixed material was prepared, press-molded, presintered at 900° C., formed into a predetermined shape and then subjected to vacuum sintering at 1,380° C. for one hour to obtain a material.

Mold Forming into Helical Gear

Figure 2:
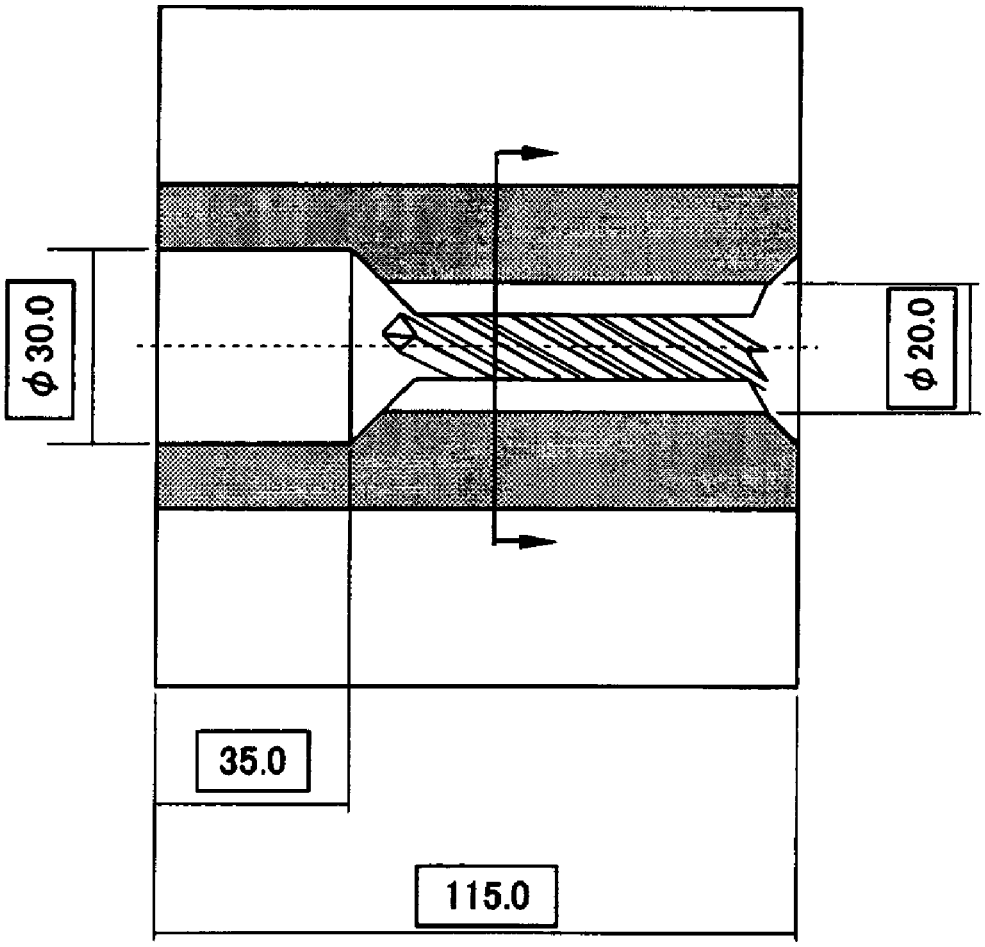
FIG. 2 is a front view showing a die of a helical gear.

A mold shown in FIG. 2 was produced. A casing material for protecting this developed cemented carbide is a material of SNCM8 and casing was performed by setting an interference to the cemented carbide to 0.5%. The inside diameter surface of the cemented carbide was machined into a helical gear shape by electric discharge machining using a Cu—W electrode formed into a male mold, and then final finish lapping was performed with tertiary accuracy.

After the completion of finishing of the inside diameter surface of the alloy, the product is removed from the casing, subjected to TiC+TiN CVD coating and then coated again to obtain a completed mold.

Evaluation of Actual Machine

All conventional die molds are coated with CVD (TiC+TiN). In this example, a CVD treated product and a non-treated product were compared.

The results are shown in the following table. In case of a comparative alloy, burning occurred in very early stage in a die which is not treated with CVD and showed the shortest lifetime, and a die which is not treated with CVD made of a developed alloy showed the longest lifetime. The reason why the lifetime of the CVD-treated developed alloy is not extended because of chipping of the gear tooth portion is considered that cracking is generated in the coat and propagated to a cemented carbide base material As is apparent from the fact, this developed alloy is an ideal tool material which is excellent in wear resistance even when it is not subjected to a coating treatment and is excellent in chipping resistance because of toughened structural characteristics, and also has remarkably improved fatigue lifetime.

TABLE 2

| Division | No. | CVD treatment Yes | CVD treatment No | Lifetime of die | Cause of failure (state of defects) |
|---|---|---|---|---|---|
| Developed alloy | 1 | ○ | | 78,800 | Cracking and chipping of gear teeth portion |
| | 2 | ○ | | 60,600 | Burning of gear teeth portion |
| | 3 | | ○ | 156,100 | Wear of gear teeth portion |
| | 4 | | ○ | 134,200 | Wear of gear teeth portion |
| Comparative alloy | 5 | ○ | | 12,500 | Cracking and chipping of gear teeth portion |
| | 6 | ○ | | 18,900 | Burning originated from chipping |
| | 7 | | ○ | 173 | Burning of gear teeth portion |
| | 8 | | ○ | 525 | Burning of gear teeth portion |

Example 2

Trial Manufacture of Casing Bit

Figure 3:
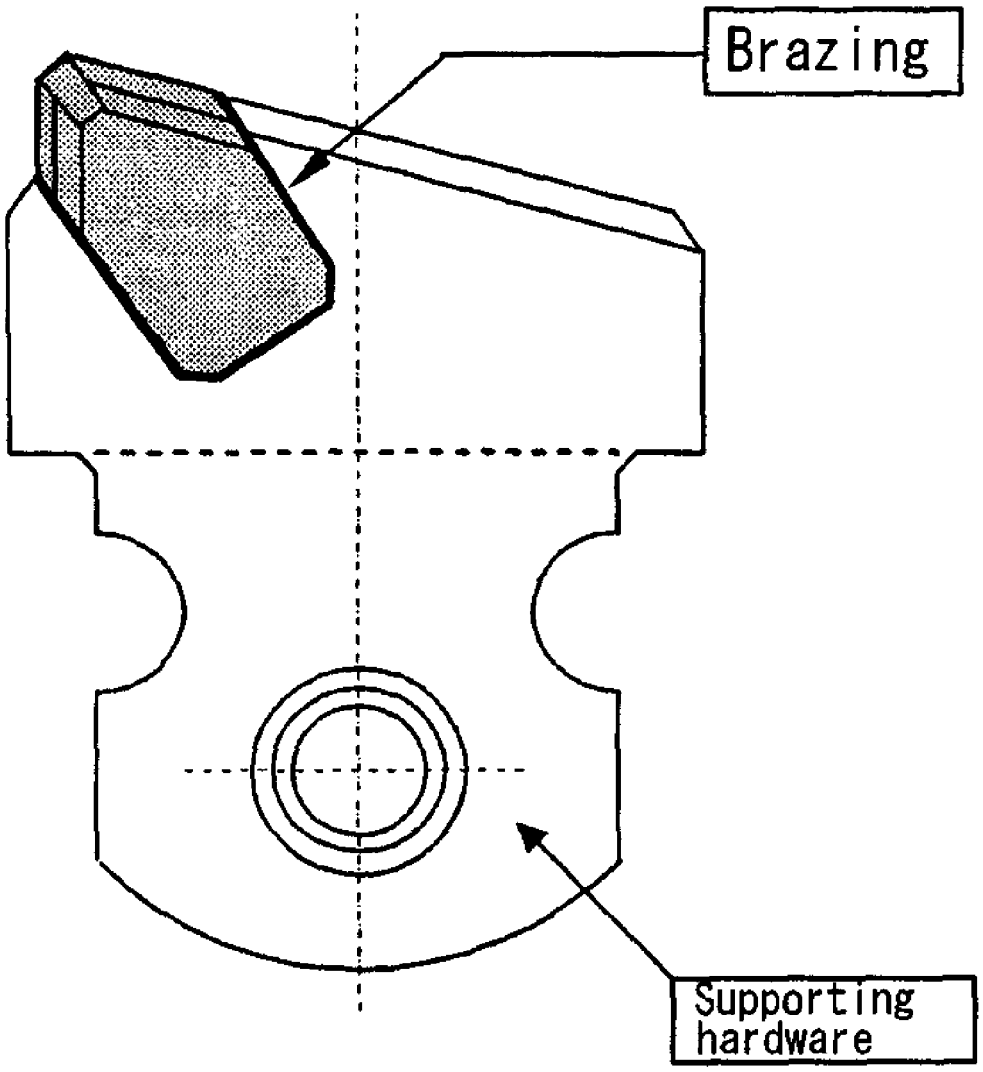
FIG. 3 is a front view showing a digging tool wherein a S55C supporting hardware is brazed with a cemented carbide.

A casing bit is a bit used for foundation working of building structures. As shown in FIG. 3, it is a digging tool wherein a S55C supporting hardware is brazed with a cemented carbide. The ground is dug from the surface of the ground to the underground by applying a load while rotating a steel pipe after fixing a tip of the pipe. The digging depth is the depth up to a base rock layer having a sufficient strength. For example, digging is allowed to proceed by connecting the steel pipe in case of the depth of 30 m or less. Digging performances are largely influenced by characteristics of the cemented carbide with which the bit is brazed. To avoid failure of the cemented carbide, a cemented carbide comprising coarse grains has conventionally been used. However, wear proceeds in the cutting portion made of the cemented carbide in an early stage because digging is performed under very high pressure, thus making it impossible to maintain digging capability. On the other hand, when a cemented carbide comprising middle or fine grains is used, chipping or breakage of the cutting portion made of the cemented carbide rapidly proceeds, sometimes. In this case, digging does not proceed and a large problem such as delay of work period arose. To solve these problems, we are intended to apply an alloy of the present invention. Regarding assumed mechanical properties, target hardness HRA of the surface layer portion was from 90 to 91.5, and target fracture toughness $K_{IC}$ was from 20 to 25 MN/m$^{3/2}$.

Trial Manufacture of Raw Material

In this example, the raw material used in trial manufacture of the die for helical gear was used.

Press Molding

To obtain a final size measuring 40×22×40 of a sintering material, press molding (coefficient of linear contraction F=1.25) is performed to form a compact measuring 50×100×150.

Primary Presintering

Dewaxing was carried out under an $N_2$ carrier gas atmosphere at a temperature within a range from 350 to 400° C.

and presintering was carried out by a heat treatment under a vacuum atmosphere at a temperature within a range from 850 to 900° C. for 2 hours.

Forming

A working size was calculated by calculating a contraction ratio of a presintered body with high accuracy and the presintered body was formed into a compact having a size, which is about 1.25 times larger than that of a sintered material shown in a schematic view, using various cutters and grinders using a diamond tool.

Secondary Presintering

To improve the strength of the compact, the compact was presintered under a vacuum atmosphere at 1,100° C. for one hour.

Dipping Treatment

An aqueous 30% solution of ammonium tungstate (AMT) and cobalt nitrate was used. The time of dipping the compact was 20 seconds. After the dipping treatment, the compact is taken out and then immediately dried by a dryer at a temperature of 120° C.

Reducing Heat Treatment

A heat treatment was performed under a vacuum atmosphere at 1,300° C. for one hour. The X-ray diffraction due to T.P revealed a double carbide of two phases $Co_2W_4C$ [$M_6C$] and $Co_3W_9C_4$ [$M_3C$], in addition to a WC, Co phase, in the surface layer portion. Since densification of the compact proceeds at a temperature of 1,300° C. or higher, internal diffusion of carbon proceeds very slowly in case of the following carburizing treatment.

Carburizing Heat Treatment

The carburization was performed at a temperature of 1,100° C. for 30 minutes at a $CO+H_2$ gas flow rate of 20 ml/min in this example. The gas to be used may be a carburizing gas and the temperature range corresponds to a solid phase region of W—C—Co, and therefore phase transformation into WC+Co from the double carbide is performed extremely stably and easily.

Liquid Phase Sintering

The treatment was performed in a vacuum sintering furnace at a temperature of 1,420° C. for one hour.

Coating with Boron Compound

The external surface of the sintered body material thus obtained was coated with an alcohol slurry having a $B_4C$ concentration of 20% and then dried by a dryer set at a temperature of 40° C. for one hour.

Diffusion Heat Treatment

After coating and drying, the material is subjected to a diffusion heat treatment at 1,300° C. for 2 hours. Finally, the binder metal is scarcely remained in the surface layer portion region and a metal-rich structure is formed in the interior.

Mechanical properties of the developed alloy thus obtained are roughly classified into the followings in case of the surface layer portion and the interior.

As a comparative alloy, a bit sample and TP were produced using a WC-14% Co alloy having a WC grain size of 6μ, and then compared.

TABLE 3

| Site | Specific gravity g/cm$^3$ | Hardness HRA | Fracture toughness MN/m$^{3/2}$ |
|---|---|---|---|
| Surface portion of developed alloy | 15.05 | 90.8 | 24.8 |
| Inner portion of developed alloy | 14.03 | 87.7 | 19.6 |
| Comparative alloy WC—14Co | 14.22 | 87.2 | 18.8 |

Production of Casing Bit

A supporting hardware produced from a S55C forged product by cutting was subjected to a heat treatment, thereby adjusting the hardness HRC within a range from 35 to 40, and then high frequency brazed with a cemented carbide material in the form of an insertion blade to obtain a casing bit. The bit includes L and T type bits, and the bit shown in the schematic view is an R type bit and the bit in the opposite direction (linear symmetry) is an L type bit. The bit is commonly attached to a tip of the pipe in the sequence of -R-R-L-R-R-L- and was attached to a casing pipe in this sequence.

Evaluation on Actual Machine

A casing pipe used for digging had a diameter of 2200 mm and the total number of bits used for the tip is 36. Specifically, the number of R type bits was 24 and that of the L type bits was 12. As a result of geological survey, a sand gravel layer and boulder are present at the depth ranging from 8 to 12 m and a mean digging depth of a foundation pile was about 18 m. Lifetime of the bit was evaluated by the number of bits replaced per foundation pile. After the completion of digging for the foundation pile of 18 m, the entire pipe was removed and the worn state of the bit was observed. When the replacement is required, the bit was replaced by a new one.

These results are shown in the following table. As is apparent from the results, lifetime of the developed alloy bit is 11 to 18 times longer than that of a comparative material and stable high lifetime is obtained.

TABLE 4

| Division | Size of foundation pile | Number of bits replaced R type | Number of bits replaced L type | Failure pattern |
|---|---|---|---|---|
| Bit made of developed alloy | 2.2 in diameter × 18 m | 0.22 | 0.10 | Almost all of failures were caused by wear |
| Bit made of comparative alloy | | 2.56 | 1.81 | 80% of failures were caused by breakage |

Second Embodiment

A sintered tool is integrally formed of an inner portion and a surface layer portion formed by a heat treatment so as to surround the inner portion and, basically, the inner portion contains hard grains and a binder metal for binding these grains. In the second embodiment, the surface layer portion essentially contains hard grains, boron B and/or silicon Si. The surface layer portion may contain a binder metal, but preferably contains the binder metal in the amount smaller than that in case of the inner portion, or substantially contains no binder metal so as to increase surface hardness.

Hard grains in the sintered tool contains carbide, nitride or carbonitride. At least one kind can be selected from the group consisting of WC, TiC, TaC, NbC, VC and $Cr_2C_3$ as the carbide, and at least one kind can be selected from the group consisting of TiN, TaN, NbN, VN, $Cr_2N$ and ZrN is selected as the nitride.

As the binder metal, at least one kind is selected from the group consisting of ferrous metals, for example, Fe, Ni and Co. In view of corrosion resistance, heat resistance and oxidation resistance, Ni or Co can be preferably employed. Ni and Co form a solid solution with B in the surface layer portion, and form its hard boride NiWB, CoWB in the copresence of WC and contribute to surface hardening. Silicon Si forms a solid solution with Si in the surface layer portion, and forms its hard silicate $NiWSi_4$, $CoWSi_4$ and contributes to surface hardening.

The inner portion is made of a sintered body of hard grains and a binder metal and a ratio of the content of the binder metal to that of hard grains is within a range from 5:95 to 40:60. When the ratio of the content of the binder metal to that of hard grains is less than 5:95, a sintered body cannot be formed because of too small content of the binder metal. When the ratio is more than 40:60, the sintered body cannot be sufficiently hardened because of too small content of the hard metal.

The ratio of the content of the binder metal to that of hard grains is preferably within a range from 5:95 to 30:70. This ratio is selected depending on the application of the sintered tool. In the application which requires surface hardness and toughness, particularly impact resistance, are required, the content of hard grains is decreased and the content of the binder metal is increased. In the application which particularly requires surface hardness and wear resistance, the content of hard grains is increased within the above range.

As described hereinafter, as the surface layer portion of the sintered tool, a boron and/or silicon Si-containing layer wherein boron B and/or silicon Si are diffused from the surface of the sintered body during the heat treatment of the sintered body with the above composition.

In the present invention, this surface layer portion contains boron B or silicon Si alone or in combination in the amount within a range from 0.010 to 2.0% by weight. In the surface layer portion, distribution density of hard grains is adjusted to higher value than that of the inner portion. It is particularly preferable that the content of boron or silicon of the surface layer portion is within a range from 0.050 to 1.0%. In case of containing both boron and silicon, the total amount is preferably within the above range.

The content of the binder metal is less than that of the inner portion. The content of boron B or silicon Si is from 0.010 to 2.00% so as to secure hardness of the surface layer portion ⌀hardness. When the content of boron or silicon is less than 0.010%, diffusion migration of the binder metal from the surface layer portion to the interior becomes insufficient during the diffusion heat treatment. On the other hand, when the content exceeds 2.00%, the surface layer portion does not conform to volume change caused by internal diffusion of the binder metal phase, and thus surface cracking is likely to occur during the diffusion heat treatment. When the content of boron or silicon is adjusted within a range from 0.050 to 1.0%, diffusion of the binder metal from the surface layer portion to the interior can be enhanced and also the effect of effectively preventing surface cracking is exerted. Consequently, in the surface layer portion, the content of the binder metal is relatively decreased and the content of hard grains is increased as compared with the inner portion. Consequently, it is possible to decrease a mean distance between adjacent hard grains. When estimated with the volume, distribution density of hard grains is more than that of the inner portion and surface hardness is more than that of the inner portion by high density hard grains.

Distribution density of hard grains is the highest in the vicinity of the surface in the surface layer portion and decreases toward the depth direction of the surface layer portion, and approaches to distribution of the inner portion. With gradient distribution of hard grains, the content of the binder metal is less than that of the inner portion in the surface layer portion, and also hardness distribution is gradient so as to decrease from the vicinity of the surface to the inner portion.

The mean content of the binder metal element is preferably 2% by weight or less from the surface of the surface layer portion to the depth of 0.5 mm. As described above, the surface layer portion of the tool of the present invention is substantially composed of a hard grain phase, a boride phase and/or a silicate phase, and high surface hardness of the tool surface is obtained by hardening due to aggregation of hard grains and boron and/or silicon compounds.

In the sintered tool of the present invention, the mean grain size of hard grains in the sintered tool is preferably within a range from 0.2 to 15 μm. As hard grains are more refined, hardness increases. When the grain size is less than 0.2 μm, the amounts of combined carbon and nitrogen of the hard grain phase vary and it becomes impossible to maintain stability of surface hardness. On the other hand, when the grain size exceeds 15 μm, wear resistance deteriorates and therefore the grain size within the above range should be avoided. The grain size of the surface layer portion and the inner portion vary depending on the application and shape of the tool, but a mean grain size is preferably within a range from 0.5 to 10 μm.

In the surface layer portion, as described above, the content of the binder metal is decreased. In the structure of the surface layer portion, fine hard grains are densely distributed and the mean distance between adjacent hard grains of the surface layer portion can be decreased as compared with the inner portion. Such a fine structure of the surface layer portion increases hardness of the surface layer portion composed of hard grains containing boride, decreases a friction coefficient, and enhances wear resistance and strength at high temperature.

As described above, the surface layer portion contains both hard grains and boron, and boron is combined with a binder metal to form a ferrous metal boride, while a boride exists as a precipitated phase between hard grains. An iron group boride itself is hard and therefore hardening is recognized in the surface layer portion by contribution of the iron group boride. The boride contains FeWB, NiWB or CoWB in the copresence of WC. The silicate contains $NiWSi_4$ or $CoWSi_4$ in the copresence of WC.

As described above, in the sintered tool, WC as a main component, or TiC or a mixture thereof can be used as hard grains, and Ni or Co can be used as the binder metal. As an example of the tool, when WC is used as hard grains and Co is used as the binder metal, the inner portion is composed of a WC phase and a metallic Co phase (Co solid solution) as a fine grain phase with the composition decided by a predetermined amount, while the surface layer portion contains a WC phase and a finely deposited CoWB phase (if a Co phase exists, a very small amount of a Co solid solution phase) as a boride phase. Also, the surface layer portion contains a finely deposited $CoSi_2$ phase, a $WSi_2$ layer and a $CoWSi_4$ layer as the silicate phase.

Surface hardness Hv of the WC—Co sintered tool of the present invention depends on hardness of the inner portion, but is 1,000 or more, usually within a range from 1400 to 1800, and preferably 2,300 or more.

When the thickness of the surface layer portion is defined as a distance, which is required for the linear portion of a hardness distribution curve from the surface to the interior to reach the mean hardness of the inner portion, the thickness of the surface layer portion is 2 mm or more, and preferably 4 mm or more.

As described above, the surface layer portion of the present invention exerts the surface hardening effect by increase of the density of the ferrous metal boride, and the inner portion can secure desired toughness, hardness and strength by desired mixing of the hard grains and binder metal.

According to the method for producing a sintered tool of the present invention, first, a sintered body is produced. A conventional sintered body is obtained by compressing a mixed powder of hard grains and an iron group binder metal to from a compact having a desired shape, which is then subjected to a conventional liquid phase sintering. Thus, a densified uniform sintered body is obtained. According to this sintering method, the entire compact is sintered. After sintering, the resulting sintered body can be appropriately machined into a desired shape with accuracy by a cutting, grinding or electric discharge machining operation.

Then, a boron or silicon coating layer is formed on the surface of the sintered body. To form this kind of a coating layer, a boron coating agent containing boron is coated, and then the sintered body comprising a boron coating layer is heated by a heat treatment to form a surface layer portion enriched with boron or silicon.

In this heat treatment, the sintered body comprising a boron coating layer is heated and maintained in a vacuum, or inert gas, preferably nitrogen gas atmosphere, at the temperature within a range from a liquid phase temperature in the inner portion of the sintered body to the temperature which is higher than an eutectic temperature of the boron-containing phase in the sintered body for a desired time. During the heat treatment, boron in the boron coating layer is diffused from the surface of the sintered body to the interior to form a surface layer portion enriched with boron, and a melt in the surface layer portion is diffused and migrated to the inner portion, and then distribution density of hard grains in the surface layer portion of the sintered body is increased. After cooling, boron or silicon is precipitated as a boride and/or silicate phase containing a binder metal in the surface layer portion to obtain a sintered tool comprising a hardened surface layer portion.

While details of the method for producing a sintered tool of the present invention were described above by way of the sintered tool, hard grains contain carbide, nitride or carbonitride and, particularly, at least one kind selected from the group consisting of WC, TiC, TaC, NbC, VC and $Cr_2C_3$ is used as the carbide and at least one kind selected from the group consisting of TiN, TaN, NbN, VN, $Cr_2N$ and ZrN is used as the nitride. As the other binder metal, ferrous metal, namely, at least one kind is selected from the group consisting of Fe, Ni and Co.

When Ni or Co as the binder metal contains B or Si, the eutectic temperature of a Ni—B or Ni—Si alloy or a Co—B or Co—Si alloy, a Ni—W—B or Ni—W—Si alloy or a Co—W—B or Co—W—Si alloy is lower than a solidus temperature of an alloy of Ni or Co and the above carbide. Therefore, a Ni—W—B or Ni—W—Si alloy or a Co—W—B or Co—W—Si alloy is employed for a heat treatment and, as described hereinafter, distribution of hard grains in the surface layer portion is increased as compared with the inner portion, and thus employed for surface hardening.

A ratio of the content of the raw material of hard grains to the content of the raw material of the binder metal is preferably within a range from 5:95 to 30:70. This ratio of the content is selected depending on the application of the sintered tool. In the application which requires both surface hardness and toughness, particularly impact resistance, the content of hard grains is decreased and the content of the binder metal is increased. In the application which particularly requires surface hardness and wear resistance, the content of hard grains is increased within the above range.

The mean grain size of raw hard grains is preferably within a range from 0.2 to 15 μm, and more preferably from 0.5 to 10 μm.

Using the raw hard grains, the grain size of the surface layer portion and the inner portion in the product tool is obtained by the sintering and heat treatment, but varies depending on the application and shape of the tool. Particularly, the mean grain size of hard grains in the sintered tool is within a range from 0.2 to 15 μm. As described above, surface hardness increases as hard grains are more refined. When the mean grain size is less than 0.2 μm, the amounts of combined carbon and nitrogen of the hard grain phase vary and it becomes impossible to maintain stability of surface hardness. On the other hand, when the grain size exceeds 15 μm, wear resistance deteriorates and therefore the grain size within the above range should be avoided. The grain size of the surface layer portion and the inner portion vary depending on the application and shape of the tool, but a mean grain size is preferably within a range from 0.5 to 10 μm.

A mixed powder of hard grains and a binder metal is compressed into a compact having a desired shape and the compact is then sintered similar to the case of conventional sintering components. The compact is presintered and then sintered to obtain a dense sintered body. For example, conventional liquid phase sintering can be applied.

In the boron or silicon coating step of the present invention, the surface of a sintered body is coated with a coating agent containing boron or silicon, and a boron coating material used for coating contains a boron compound and also contains an oxide, a nitride or a carbide of boron, or, a precursor thereof, for example, a carbonate or a hydroxide. For example, $SiB_6$, BN, $B_4C$, $B_2O_3$, $H_3BO_3$, borane or an organic boron compound can be used in the coating material. The silicon coating material contains a silicon compound and also contains a carbide or a nitride, a boride, or a precursor thereof, or an intermetallic compound. Specific examples thereof include Si, $SiH_4$, $SiCl_4$, SiC, $Si_3N_4$, $SiB_6$, or $CoSi_2$, $MoSi_2$, $CrSi_2$, $WSi_2$, or silanes, polysilane polymers, and organic silicon compound.

The boron coating material may contain these boron compounds and coated on the surface of the sintered body. This coating material may be directly applied to this surface, but is preferably coated on the surface of the sintered body after a slurry-like coating solution is prepared by dispersing these boron compounds in water or a non-aqueous solvent so as to ensure satisfactory coating. In case of coating, a method of brush coating a coating solution on the surface of a sintered body, a method of spray coating and a method of dipping a sintered body in a coating solution bath and pulling up the coated sintered body are used. Then, the coating solution is dried on the surface of the sintered body, thus remaining the coating material.

The coating solution may be coated over the entire surface of the sintered body. When the surface to be hardened of the sintered tool is limited and the coating of the coating material of the other surface portion is prevented by a proper masking, the surface layer portion is formed only on the desired area by the heat treatment step and surface hardening of the tool can be performed by the surface layer portion, and thus other surface portion is relatively soft and can maintain high toughness.

In the step of coating with boride or silicate, there can also be used a method of introducing a chloride, a fluoride, a hydride and an organic metal compound into a heating furnace, decomposing them and coating on the surface of a sintered body surface through deposition. This method is commonly referred to as a chemical vapor deposition [CVD] method. In addition to a conventional normal pressure CVD method and a reduced pressure CVD method, a plasma CVD method, a thermo-CVD method or a laser CVD method have recently been developed and the film forming rate through deposition is improved to 0.1 μm/sec or more.

Examples of the material used as a raw material source include chloride such as boron trichloride or boron tetrachloride; fluoride such as boron trifluoride or silicon tetrafluoride; hydride such as boron hydride (borane), diborane, pentaborane, dihydroborane or a derivative thereof; and silicon hydride (silane) includes monosilane or disilane. Examples of the organic metal compound include organic boron compound or organic silicon compound, for example, trialkylboron, chlorosilane or alkoxysilane. Specific examples thereof include trimethylboron, triethylboron, tri-n-propylboron or tri-n-butylboron, and dichloromethylsilane, chlorodimethylsilane, chlorotrimethylsilane or tetramethylsilane. Examples of the other compound include organic boron acids.

Specifically, these compounds are converted into gaseous compounds and the gaseous compounds are introduced into a heating furnace set, at a temperature at which the compounds can be decomposed, using a carrier gas at a predetermined flow rate, and then a boride or silicate is deposited on the surface of the sintered body by the decomposition of the compound. When continuous decomposition and deposition reaction proceeds for a predetermined time, a coated metal layer having a predetermined thickness is formed on the surface of the sintered body.

The thickness of the coat is controlled by the gas concentration, carrier gas flow rate, heating temperature and heating time.

By thermally spraying a powder aggregate of a boride or silicide heated to a semi-melted state over the surface of the sintered body at a high rate, a dense metal coat made of a boride of silicide can be formed. Examples of the boride and silicide include $SiB_6$, SiC, $Si_3N_4$, BN and $B_4C$.

In the heat treatment, the sintered body whose surface is coated with a dry coating material containing boron or silicon is heat-treated while maintaining with heating in vacuum. The temperature of the heat treatment is lower than the solidus temperature or eutectic temperature decided by the composition of an alloy of the hard grains and iron group binder metal and is the temperature at which a melt is not formed in the inner portion of the sintered body with the composition of the sintered body, and is also higher than the eutectic temperature of an alloy containing boron or silicon and hard grains from the coating layer on the surface, and a binder metal.

According to the present invention, a melt is partially formed only on the surface or surface layer portion by utilizing the fact that the eutectic temperature of the sintered body containing boron or silicon is lower than that of the sintered body containing neither boron nor silicon, and setting the heat-treating temperature to the temperature between those eutectic temperatures. This melt is composed of almost all of boron and a ferrous metal and a portion of hard grains, and is remained as a solid.

In the WC—Co system sintered tool, as is apparent from a phase diagram of a WC—Co pseudo-two-dimensional alloy, the eutectic temperature is about 1,320° C., while the Co side eutectic point (namely, the eutectic temperature of Co—$Co_3B$) is about 1,110° C. in the Co—B sintered tool, and thus the heat-treating temperature is within a range from 1,150 to 1,310° C., and preferably from 1,200 to 1,300° C.

In the WC—Ni based sintered tool, as is apparent from a phase diagram of a WC—Ni pseudo-two-dimensional alloy, the eutectic temperature is about 1,390° C., while the Ni side eutectic point (namely, the eutectic temperature of Ni—$Ni_3B$) is about 1,090° C., and thus the heat-treating temperature is within a range from 1,150 to 1,380° C., and preferably from 1,200 to 1,370° C.

In both of the TiC—Co and TiC—Ni based sintered tools, the liquid phase appears at the temperature of about 1,270° C. and therefore the heat-treating temperature is preferably from 1,200 to 1,250° C. in the TiC—Co based and TiC—Ni based sintered tools. Furthermore, since the eutectic temperature of the $Mo_2C$—Ni based sintered tool is about 1,250° C., diffusion heat treatment of the TiC—$Mo_2C$—Ni based sintered tool can be carried out at a temperature within a range from 1,200 to 1,250° C. In this based sintered tool, mixing of $Mo_2C$ can suppress carbide grain growth in the TiC—Co based and TiC—Ni based sintered tools and can improve sinterability. Appearance of the liquid phase during the above heat treatment process and diffusion migration are the same as in case of silicon, and the Co side liquid phase of the Co—Si based sintered tool appears at about 1,200° C. and the temperature at which the liquid phase appears is lowered to 1,000° C. in the Ni—Si based sintered tools with the composition of Ni-30% Si.

Consequently, the silicon diffusion heat treatment temperature in the WC—Co system alloy is within a range from 1,250 to 1,320° C., and is within a range from 1,150 to 1,350° C. in a WC—Ni based alloy.

When the heat treatment is performed within the above temperature range, in an initial stage of the heat treatment, boron in the boron-containing coating layer formed on the surface of the sintered body reacts with ferrous metal on the surface to form a boron-containing melt with low temperature eutectic composition on the surface. Since the interior of the sintered body contains no boron, it is solid without melting at the treating temperature. With a lapse of the heat treatment time, the melt at the surface portion melts metal in the interior and penetrates into the interior. As a result of penetration and diffusion of the melt into the interior, the amount of the melt decreases in the vicinity of the surface and thus the concentration or distribution density of hard grains increase.

This region where the content of boron or silicon increased and density of hard grains increased is the surface layer portion. In the surface layer portion, the distance between adjacent grains is small and the residual amount of boron or silicon increases. When cooled or air-cooled after desired treatment time, the surface layer portion forms a compound with boron or silicon and a binder metal, and thus boride or silicate is precipitated. The surface layer portion constitutes a layer composed of boride or silicate and hard grains having high distribution density. However, according to this method, since hard grains are highly densified without growing the surface layer portion, hardening of the surface can be realized.

The content of boron or silicon of the surface layer portion after the heat treatment can be controlled by the kind of the boron or silicon compound in the coating material before the heat treatment, and the amount of boron or silicon coated per surface area of the sintered body surface. For example, the amount of boron in the boron coating layer is preferably within a range from 5.0 to 40 $mg/cm^2$ based on the coating surface in terms of a metallic boron B element. Within the above range, the surface layer portion can contain boron B in the amount within a range from 0.050 to 0.50% by weight, as described above. Such high content of boron in the surface layer portion is realized because boron is present in the form of a compound of ferrous metal. In case of silicon, the same shall apply hereinafter.

When the method of the present invention is applied to a WC—Co sintered tool, surface hardness varies depending on the hardness of the inner portion, but is preferably (Vickers hardness Hv) 700, particularly 1,000, more than the surface hardness of the inner portion, and is commonly within a range from 1,400 to 1,800, and preferably 2,300.

When the thickness of the surface layer portion is defined as a distance, which is required for the linear portion of a hardness distribution curve from the surface to the interior to reach the mean hardness of the inner portion, the thickness of the surface layer portion is 3 mm or more, and preferably 6 mm or more.

The sintered tool of the present invention can be widely applied for cutting tools, plastic working tools, and rock drilling bits for mining and civil engineering and building.

Examples of the cutting tool include single tool blade, fraise, drill and reamer. Since drill and reamer are made of a sintered body of ultramicrofine hard grains having a grain size of 1.0 μm or less and a ratio of the diameter D to the tool length L, (L/D), is high, a material having high toughness is required. With a fine structure of the present invention in which the center portion has high toughness and the surface layer portion had high hardness, the surface layer portion has high hardness, which is advantageous for constitution of a tooth point, and thus tool lifetime can be increased.

Examples of the working tool include press mold and forging die and punch, and the sintered tool of the present invention can be applied therefore. The mold, for example, a mold for canning is conventionally made of a ceramic material or an Ni based cemented carbide. The ceramic is likely to cause surface chipping and it is difficult for the cemented carbide to constitute the metallographic structure. However, according to the present invention, when a WC—Co system sintered body is subjected to a boron diffusion heat treatment thereby impregnating with boron, resulting in high distribution density and high hardness of hard grains, and thus obtaining a mold having long lifetime with high wear resistance, adhesion resistance and corrosion resistance.

The working tool also includes drawing die for steel pipe and wire drawing plug, and a conventional cemented carbide has a problem such as burning and is used after coating the surface of the cemented carbide with TiN so as to prevent burning. However, burning is likely to occur. When a WC—Co system sintered tool of the present invention is used and subjected to a boron diffusion heat treatment, CoWB (or Si) of the surface layer portion decreases a friction coefficient, thus making it possible to improve adhesion resistance and to extend the lifetime of the tool.

Other working tool includes a hot extrusion die for aluminum alloy and, when using a sintered tool of the present invention in place of a conventional steel for hot die, adhesion resistance is improved by an extrusion temperature of about 500° C. in the presence of a CoWB or CoWSi phase of the surface layer portion, and thus die lifetime can be improved.

Furthermore, a cold forging punch for backward extrusion applies large compression loading and very high frictional force with the workpiece and is therefore used under severe conditions. Therefore, it is often used in the state of being subjected to a coating treatment. According to the present invention, it is possible to prevent breakage accident because of poor roughness of the punch and to reduce burning wear of the bearing portion of the punch, resulting in improved tool lifetime.

Example 3

In this example, commercially available tungsten carbide WC powder with an average particle size of 1.5 μm and metal cobalt Co powder with an average particle size of 1.3 μm were mixed to prepare mixtures with two different levels of cobalt, i.e., WC-10% Co and WC-20% Co materials. The powder mixtures were compressed using dies to compacts which were subjected to intermediate sintering (or calcining), the compact after the sintering had dimensions of a diameter of 30 mm by a length of 30 mm. Thereafter, liquid phase sintering was carried out at 1400° C. under vacuum for one hour, obtaining respective sintered materials.

Next, boron carbide $B_4C$ was used as a boron source. For the preparation of a boron-containing coating material, commercially available boron carbide $B_4C$ was ball milled with ethanol for 30 hours to prepare a slurry containing 9% $B_4C$ to which polyethyleneimine was added to give a boron-containing coating slurry.

The sintered material was dipped into the coating slurry bath, and was dried in a drying machine at a temperature of 40° C. to be provided for the example.

For comparative examples, the sintered material was used instead of applying the boron-containing coating thereto.

A diffusion heat treatment was conducted on the samples of the example and comparative example, wherein the samples were placed in a vacuum heating furnace under pressure controlled in the range from 40-80 Pa inside the furnace, and at a temperature-rise rate of 5° C./min. The furnace was maintained at three levels of heat treatment temperatures of 1200° C., 1250° C. and 1280° C. for 3 hours to perform diffusion heat treatment, and thereafter, the samples were cooled in the furnace.

The heat-treated samples were cut at a length of 15 mm, and the cut surfaces polished were observed with a microscope. Thereafter, Vickers hardness was measured on the polished surface while changing measuring points along the depth from a surface of the sample.

As to a boron coating-treated sintered tool containing WC-20% Co, a sample was obtained by dipping a sintered body having a composition of WC-20% Co comprising hard particles that are fine particles (particle size: 1-2 μm) into a 9% $B_4C$ coating slurry to form a boron coating, and then performing a diffusion heat treatment with the boron on the resultant sintered body.

Figure 4:
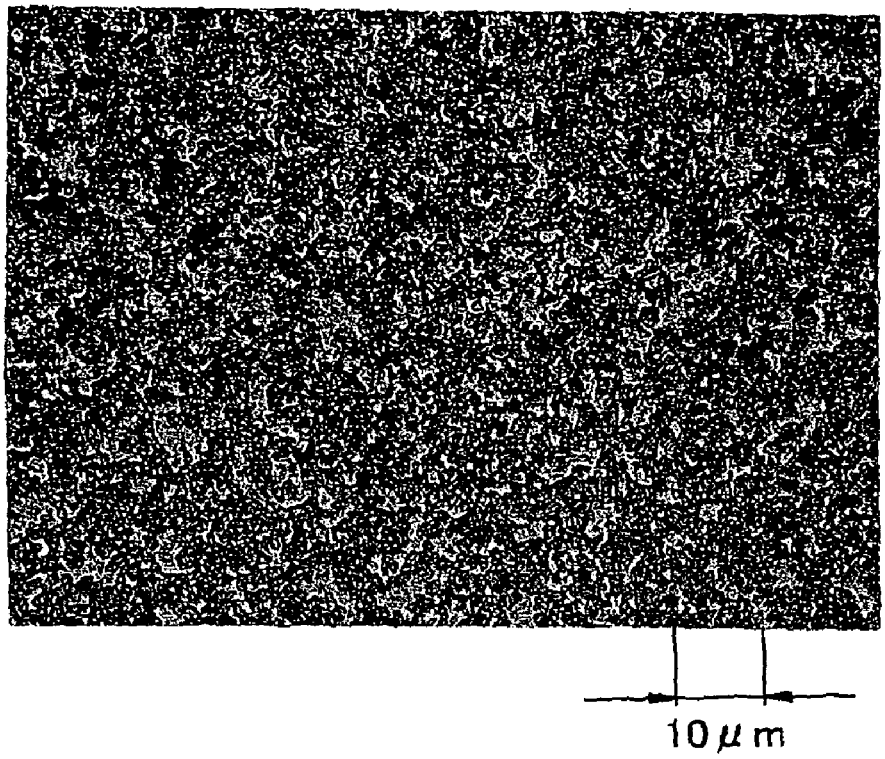
FIG. 4 is a metal photomicrograph of a cross-sectional structure of a sintered body which is coated by dipping in a 9% coating solution of fine hard grains (grain size: 1 to 2 μm) of $B_4C$ and heat-treated using a method for producing a sintered tool according to the example.
Figure 4:
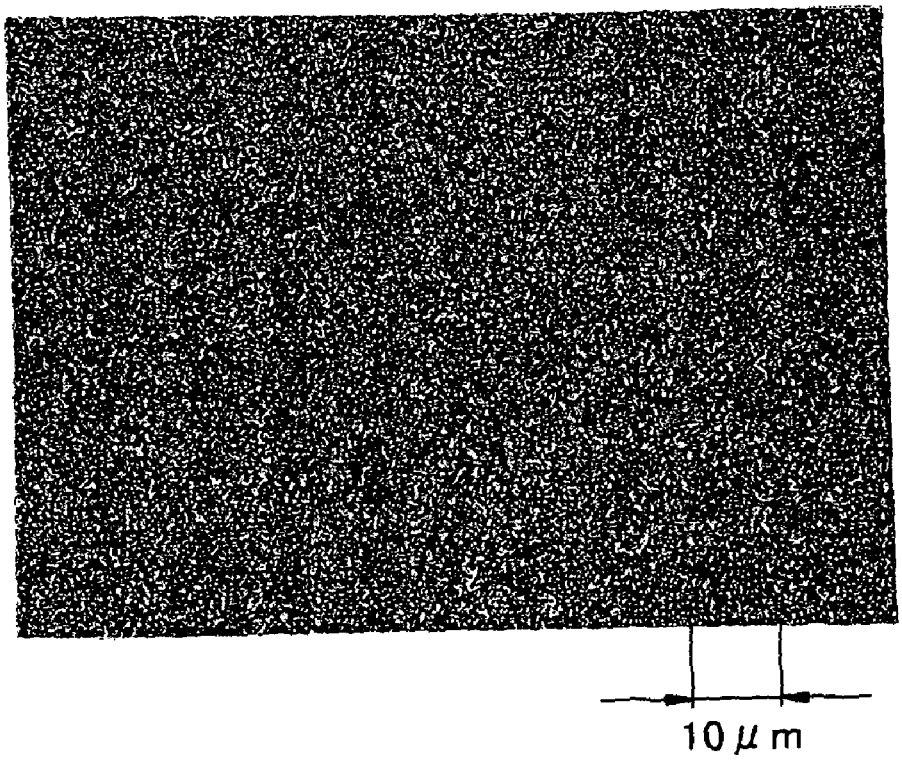

With regard to the cross sectional structure of the sample on which the diffusion heat treatment with boron has been performed, as shown in FIG. 4A, in the photograph of the structure of a core, a multiple of clear white areas of a metal Co phase are observed in WC particles. FIG. 4B shows the structure of a surface layer of this sample wherein Carbide WC is densely present and almost no white metal phase is observed. This is attributed to the result of transforming of the metal Co phase from the vicinity of the surface layer toward the core. However, it should be noted comparing FIG. 4A to FIG. 4B that carbide has almost no difference in particle size between the surface layer and the core region.

Similarly, samples were prepared by dipping sintered bodies having a composition of WC-20% Co with coarse carbide particles (particle size: 3-6 μm), into a 9% $B_4C$ coating slurry to form a boron coating on its surface, and then subjected with a heat treatment with boron diffused into the resultant sintered body.

Figure 5:
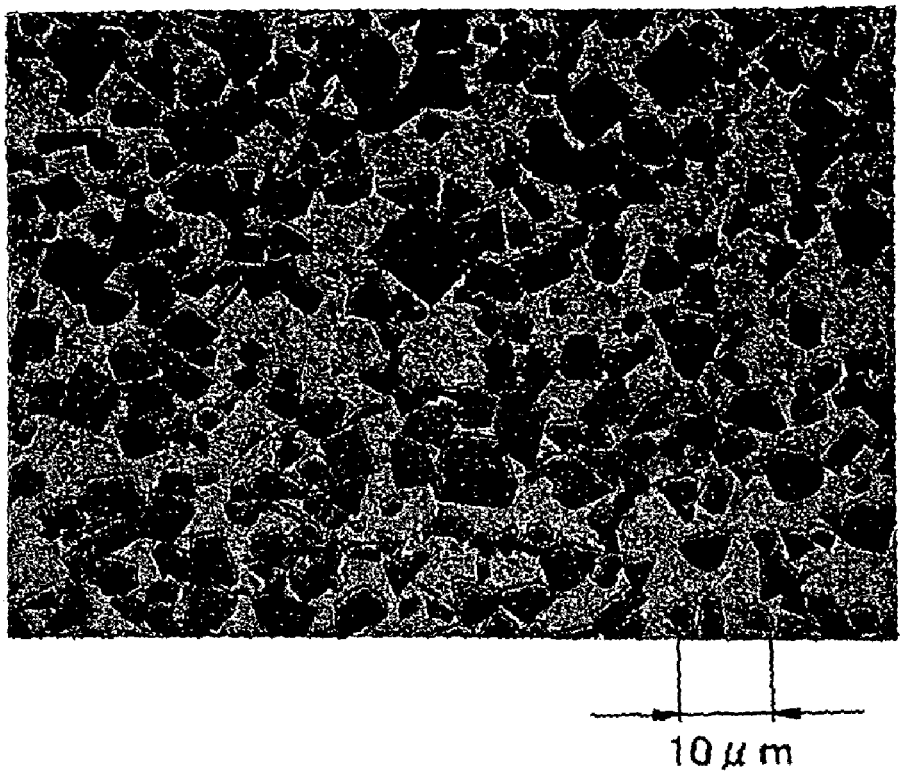
FIG. 5 is a metal photomicrograph of a cross-sectional structure of a sintered body which is coated by dipping in a 9% coating solution of coarse hard grains (grain size: 3 to 6 μm) of $B_4C$ and heat-treated using a method for producing a sintered tool according to the example.
Figure 5:
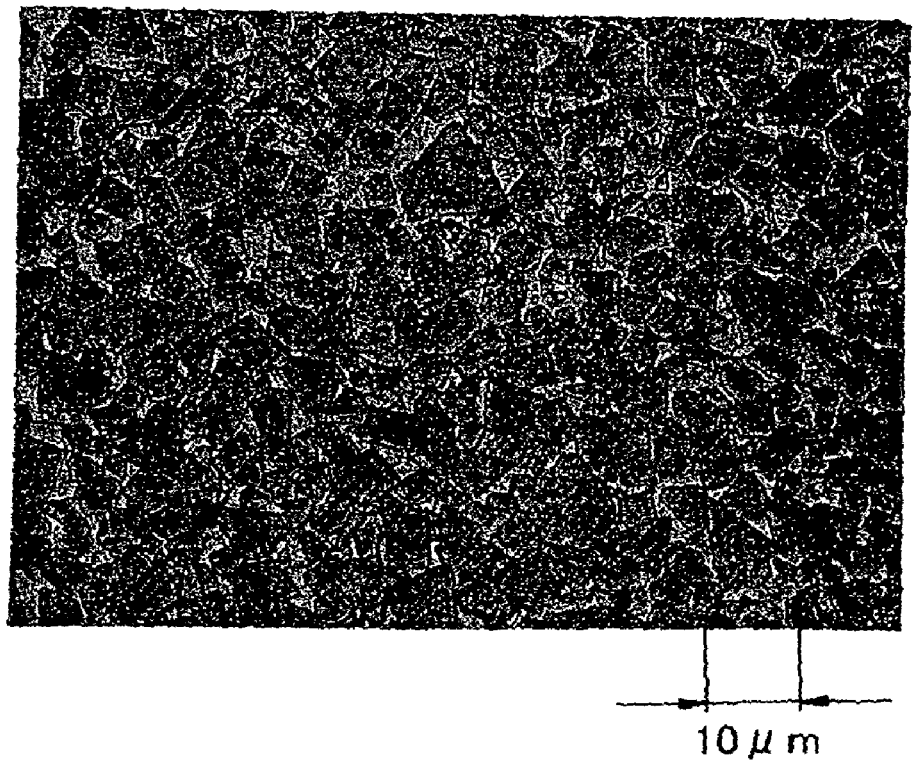
Figure 6:
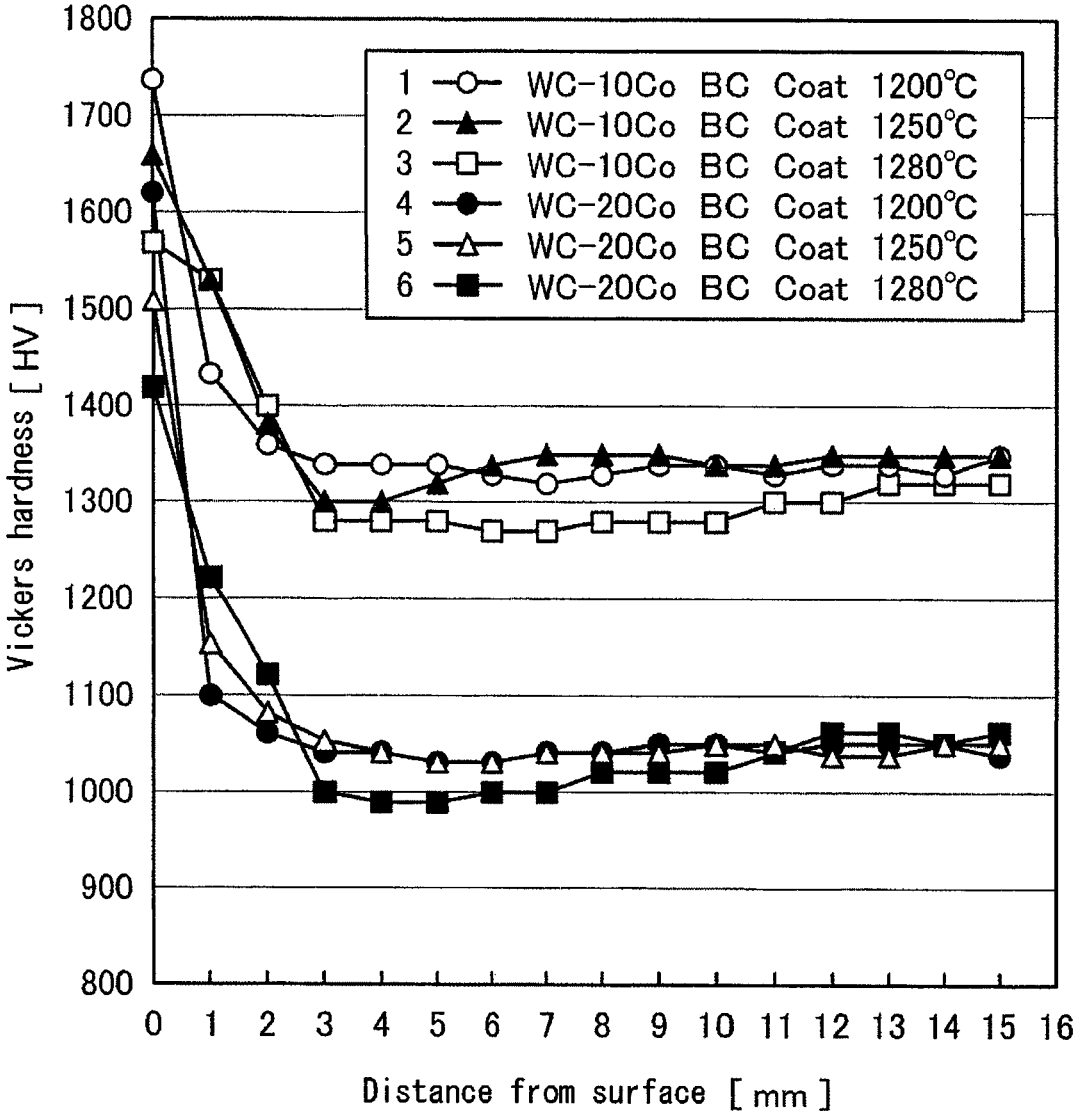
FIG. 6 is a graph showing a change in hardness in the depth direction from the surface of a sintered body according to Example 3 of the present invention.

FIGS. 5A and 5B are micrographs showing the cross-sectional structures of a core region and a surface layer, respectively, of a sample for comparison. FIGS. 5A and 5B indicate that, during diffusion heat treatment, the binder metal phase (which particles look white in FIG. 5A) are reduced in the surface layer (see FIG. 5B), compared with the core (see FIG. 5A); however, it is also seen that the particle size of hard particles (WC particles) has hardly changed between the layer and the core.

In contrast, for the metallic microstructure in the comparative example which has been untreated with coating, no large structural change was observed in both the surface layer and the core, which were similar to the FIG. 4(A).

Figure 11:
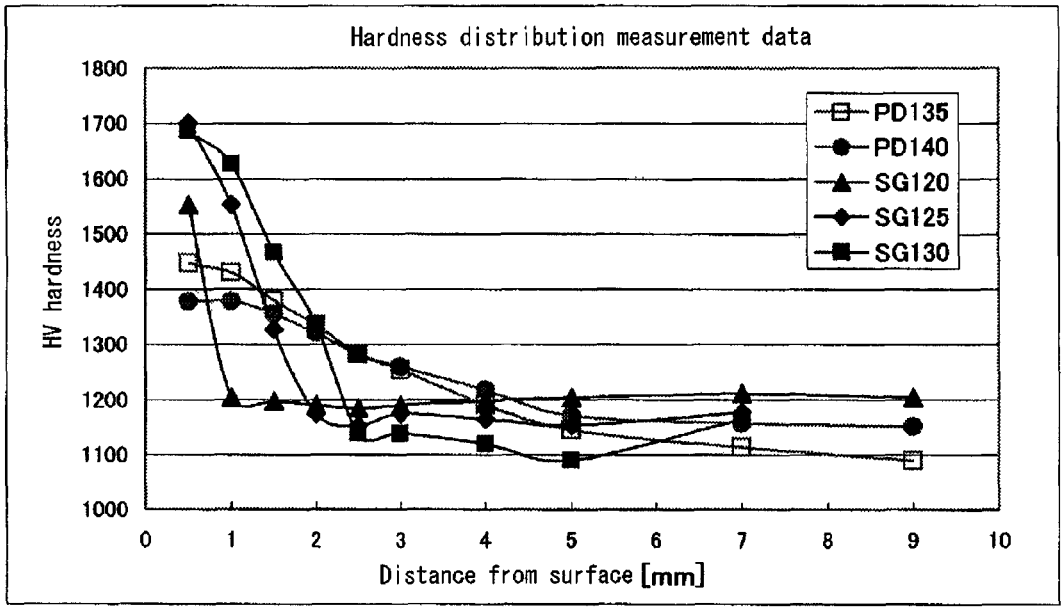
FIG. 11 is a graph showing distribution of hardness from the surface layer portion to the interior by Hv Measurement.

Further, the results of hardness measurement are shown in Table 1 and FIG. 11. As is apparent from the FIG. 11, a distinct gradient in the hardness distribution was observed for a coating-treated material. Within the extent of the heat treatment shown above, as the treating temperature is lower, hardness at the surface is higher and the thickness of the hardened surface layer is smaller.

TABLE 5

| No. | Co (%) | Boron source | Treatment temp. (C. °) | Hardness Hv Surface layer | Hardness Hv Core | Surface layer thickness (mm) |
|---|---|---|---|---|---|---|
| 1 | 10 | BC | 1200 | 1740 | 1350 | 1.5 |
| 2 | 10 | BC | 1250 | 1660 | 1350 | 2.5 |
| 3 | 10 | BC | 1280 | 1570 | 1320 | 2.5 |
| 4 | 20 | BC | 1200 | 1620 | 1040 | 1.0 |
| 5 | 20 | BC | 1250 | 1510 | 1050 | 1.0 |
| 6 | 20 | BC | 1280 | 1420 | 1060 | 2.0 |

As the heat treatment temperature is higher, the diffusion of molten metal to the core is promoted, resulting in the tendency of a thicker surface layer and a lower surface hardness. That is, a difference in hardness between the surface layer and the core is in the range from Hv 300 to 600, and samples heat-treated at a higher temperature have a lower hardness gradient relative to depth from the surface. Raising the heat treatment temperature is considered to promote boron diffusion to the core.

A major factor for improvement in hardness in the surface layer is attributed to a reduction in intervals between hard particles on the side of the surface layer due to a removal of the metal phase from the surface layer. It is presumed that another factor for the effect of improving the hardness is the form of CoWB. It is a matter, of course, that the hardness distribution of untreated products was almost uniform.

Specimens were cut out at a depth of 2 mm under the surface away from the samples to measure the boron B contents on the surface of the specimens in accordance with the ICP-MS method. The analysis results of 280-330 mg/kg were obtained, which confirms the boron diffusion.

Example 4

The sintered materials prepared in Example 1 were coated with $B_4C$ slurry with three levels of coating concentrations, i.e., 9%, 18%, 24%. Then, the products were heat treated in heat treatment conditions of a heating rate of 5° C./min and a heat treatment temperature of 1280° C. for 3 hours.

Samples thus obtained were cut at their center portions and then their cross sectional structures were observed in microscopy. Thereafter, hardness measurement was carried out by a Vickers hardness tester, changing the depths from the surfaces thereof. The results are shown in Table 6 and FIG. 7.

TABLE 6

| No. | Co (%) | Boron source (%) | Treat temp. (° C.) | Hardness Hv Surface layer | Hardness Hv Core | B in surf. layer (%) | Surf. layer thick. (mm) |
|---|---|---|---|---|---|---|---|
| 11 | 10 | BC 9% | 1280 | 1570 | 1320 | 0.16 | 2.0 |
| 12 | 10 | BC 18% | 1280 | 1530 | 1280 | — | 5.0 |
| 13 | 10 | BC 24% | 1280 | 1540 | 1300 | — | 5.0 |
| 14 | 20 | BC 9% | 1280 | 1420 | 1060 | — | 2.5 |
| 15 | 20 | BC 18% | 1280 | 1350 | 980 | — | 2.5 |
| 16 | 20 | BC 24% | 1280 | 1370 | 1040 | 0.39 | 3.0 |

Figure 7:
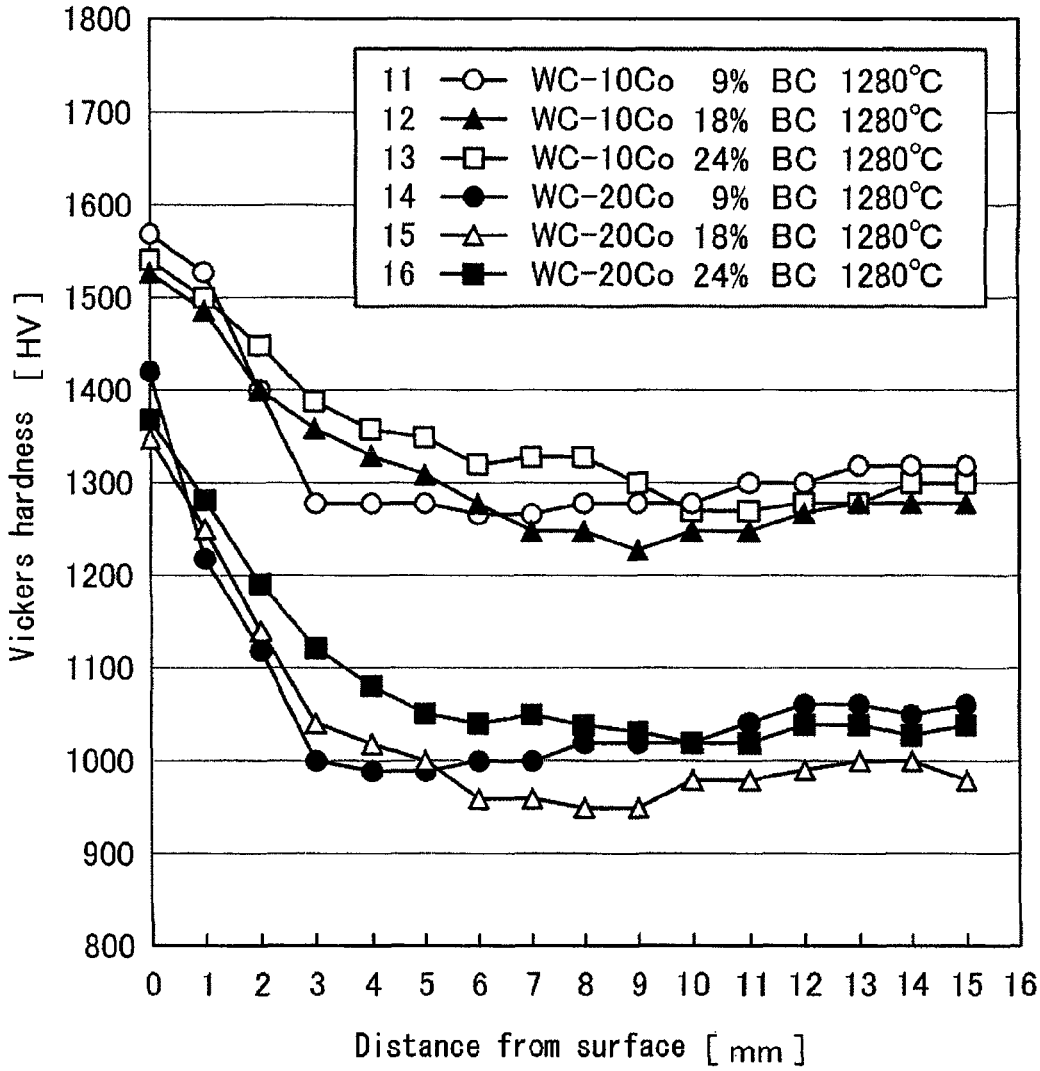
FIG. 7 is a graph showing a change in hardness in the depth direction from the surface of another sintered body according to Example 4.

Referring to Table 6 and FIG. 7, the samples of WC-10% Co and WC-20% Co including tungsten carbide WC powder with a particle size of 1.5 μm indicated a relatively large diffusion depth of 2-5 mm compared to Example 1, which demonstrates that the diffusion depth increased in proportion to the boron concentration in the coating material.

Thus, it is found that proper setting of the boron concentration in the coating material, i.e., the amount of boron added to the surface layer, and the heat treatment temperature conditions provide an appropriate hardness distribution in the surface layer.

X-ray diffraction analysis was carried out in the surface layer of the samples that were heat-treated in Embodiment 4 and indicated certain intense peaks in the spectrum corresponding to a compound CoWB. It is considered from the above results that the presence of hard boride particles has a significant effect on an improvement in the hardness of the surfaced layer.

Example 5

A powder mixture was prepared from commercially available WC powder with an average particle size of 0.55 μm, metal cobalt Co powder, chromium carbide $Cr_3C_2$ powder and vanadium carbide VC powder, all of which have an average particle size of 1.3 μm, to have a composition of 20% Co, 0.7% Cr, 0.4% V (each by weight) and the balance WC.

The powder mixture was compressed to give a compact having a given shape. In the same manner as in Example 3, the compact was subjected to intermediate sintering, followed by cutting into cylindrical bodies of 30 mm in diameter and 30 mm in length. Similarly to Example 1, the cylindrical bodies were sintered under a vacuum at 1350° C. for one hour to produce sintered materials for testing.

A coating slurry containing boron carbide $B_4C$ was used as the boron-containing coating material in the same manner as in Example 3. Further, a BN-coating slurry also was prepared wherein commercially available hexagonal crystal boron nitride (h-BN) was ground in ethanol by a ball mill for 30 hours after which polyethyleneimine was added to the resultant 9% h-BN slurry to prepare a BN coating slurry.

The two types of coating were allied on the sintered materials, namely, a coating treatment with the BC-containing slurry and, separate from this, another coating treatment with the BN-containing slurry. The BN coating treatment was performed on the sintered materials of WC-10% Co and WC-20% Co prepared in Example 1. After drying, the diffusion heat treatment was performed on all the samples at 1280° C. for 3 hours.

For the heat-treated samples, hardness was measured while changing the depths from the surfaces thereof, using a Vickers hardness tester. The results thereof are shown in Table 7 and FIG. 8.

TABLE 7

| | Binder metal (%) | Boron source | Treat temp. (C. °) | Hardness Hv Surface layer | Hardness Hv Core | Surface-layer thickness (mm) |
|---|---|---|---|---|---|---|
| 21 | 20Co—0.7Cr—0.4V | BC 9% | 1280 | 2050 | 1320 | 4.0 |
| 22 | 20Co—0.7Cr—0.4V | h-BN 9% | 1280 | 1840 | 1280 | 3.0 |
| 23 | 10 Co | h-BN 9% | 1280 | 1580 | 1300 | 2.0 |
| 24 | 20 Co | h-BN 9% | 1200 | 1410 | 1300 | 2.0 |

Figure 8:
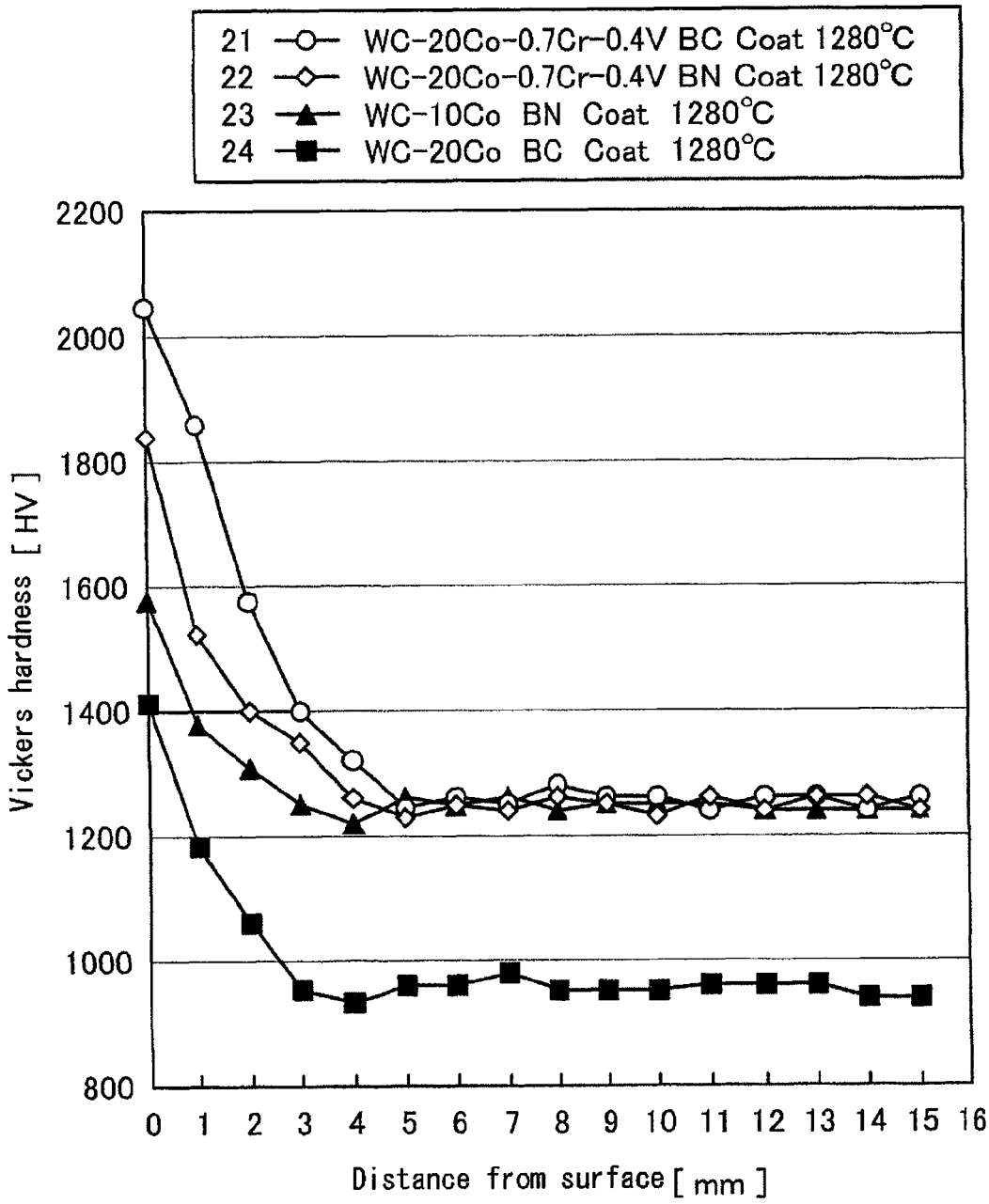
FIG. 8 is a graph showing a change in hardness in the depth direction from the surface of another sintered body according to Example 5.

Referring to Table 7 and FIG. 8, in a sample having a composition of WC-20% Co-0.7% Cr-0.4% V, which includes WC powder having an average particle size of 0.55 μm belonging to a super fine particle class, the surface hardness reached 2050 Hv after the BC coating treatment, thus, the effect of the diffusion heat treatment being recognized.

Further it is understood that BN coated WC-10% Co and WC-20% Co sintered bodies have a diffusion layer of 3-4 mm in depth, which is smaller them that of Example 1 and hardness of the surface layer portion which is lower them that of Example 1. This is caused by not easy proceeding of reaction with metal phase due to the high-temperature stable property of h-BN.

Example 6

In this example, an example using boron trichloride [$BCl_3$] as a metal chloride and hydrogen [$H_2$] is described as the metal deposition coating step.

Figure 9:
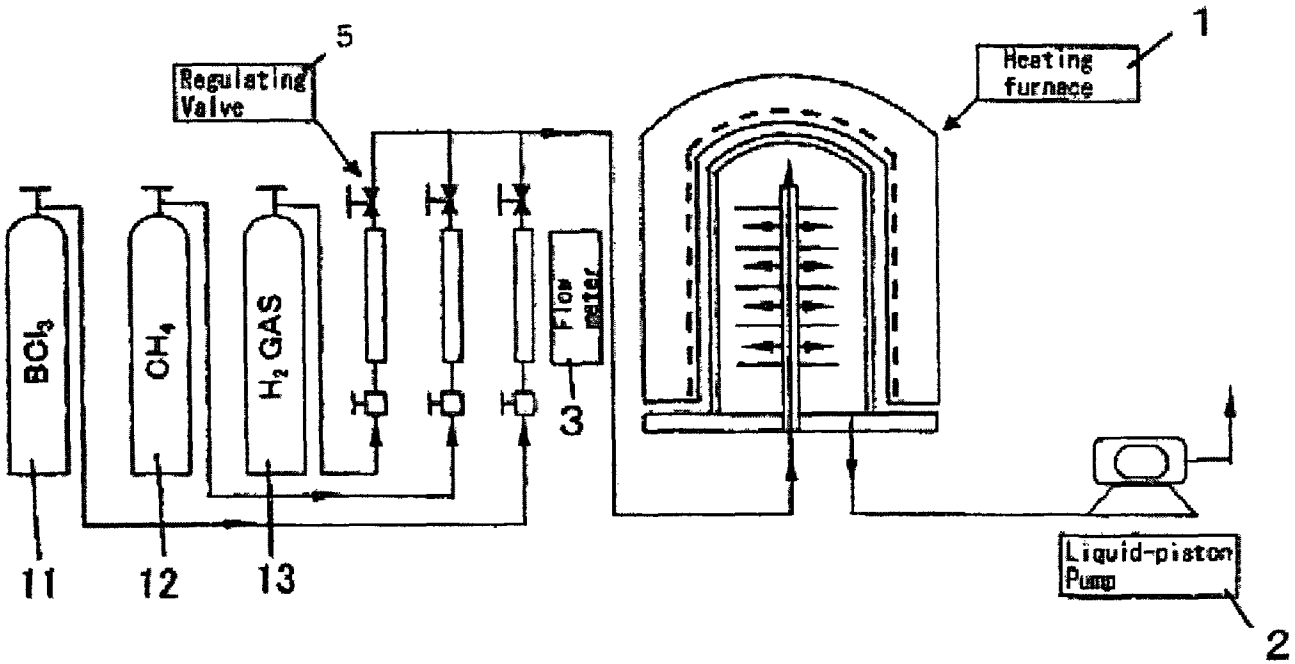
FIG. 9 is a schematic view showing a CVD system for forming a coating layer.

A CVD apparatus shown in FIG. 9 was used. A prepared gas is supplied from gas bombs 11, 12 and 13 of boron trichloride [$BCl_3$], methane [$CH_4$] and hydrogen [$H_2$] to a heating furnace 1 via a flowmeter 3 and a regulating valve 5 A liquid-piston pump 2 is connected to the heating furnace 1 so that the pressure in the heating surface is set to a desired reduced pressure. In the heating furnace 1, two kinds of sintered bodied used in Example 3 are placed and then subjected to a CVD treatment under the chemical deposition conditions shown in the following table. The thickness of a $B_4C$ film formed on the surface of the sintered bodies after the treatment was measured. As a result, it was about 12 to 15 μm.

In this example, the CVD treatment under reduced pressure was performed. To further increase the thickness, a thermal-CVD method or a laser CVD method may be used, thereby obtaining a desired thickness of the coating layer.

TABLE 8

| $B_4C$ deposition conditions | |
|---|---|
| Items | Conditions |
| $BCl_3$ | 5 vol % |
| $CH_4$ | 5 vol % |
| $H_2$ | balance vol % |
| Reaction temperature | 1000 to 1200° C. |
| Gas flow rate | 10 l/min |
| Reaction time | 5 hours |

In the above coating layer, predetermined diffusion heat treatment effect was recognized by the same heat treatment as that in Examples 3 to 5.

Example 7

Since the cemented carbide used commonly in the warm or hot region has a WC mean grain size of 3 μm or more, evaluation was performed using a WC powder of so-called middle to coarse grains.

A commercially available WC powder having a mean grain size of 5.7 μm, a commercially available Co powder having a mean grain size of 1.3 μm, a commercially available Ni powder having a mean grain size of 1.5 μm and a Cr—C powder were weighed in accordance with the composition of WC-13% Co-2% Ni-1% Cr [15LB] and WC-18% Co-4% Ni-1.5% Cr [22HB] and then mixed. A compact having the same shape as in Example 1 was produced from the resulting mixed powder, and subjected to liquid phase sintering in vacuum at 1380° C. for one hour to obtain each sintered material.

Then, a coating material was prepared using silicon carbide SiC as a silicon source of a heat treatment. The preparation method is the same as that in Example 1 and a 15% SiC-containing ethanol coating agent was prepared. The surface of the sintered material was coated by a dipping method, followed by drying and further diffusion heat treatment. The heat treatment was performed at a temperature of 1300° C. for 3 hours. A sample made of a non-coated material was also evaluated for comparison.

The sample subjected the heat treatment was cut at the position of 15 mm in length and, after polishing the cut surface, the structure of the cross section was observed. Then, hardness was measured at various positions (different depths) using a Vickers' hardness tester.

As a result of the structure observation, an improvement in distribution density of WC grains was recognized when the depth is about 2 mm from the surface layer portion. When the depth is more than the above range, the structure contained a large amount of the binder metal.

Figure 10:
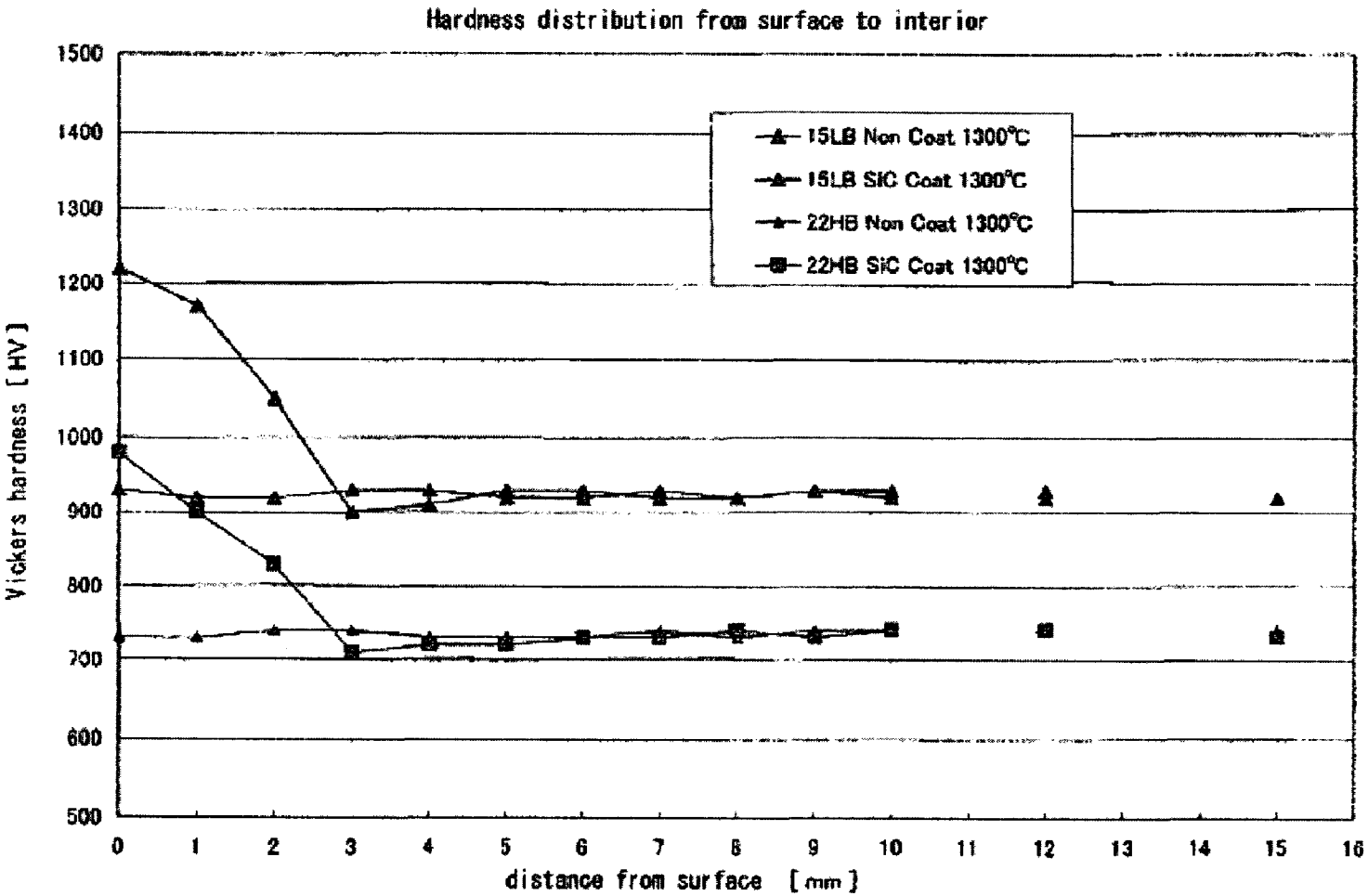
FIG. 10 is a graph showing a change in hardness in the depth direction from the surface of a sintered body according to Example 6 of the present invention.

The results of the hardness measurement are show in Table 9 and FIG. 10.

TABLE 9

| Depth from surface (mm) | 15LB Non Coat 1300° C. | 15LB Sic Coat 1300° C. | 22HB Non Coat 1300° C. | 222HB SiC Coat 1300° C. |
|---|---|---|---|---|
| 0 | 930 | 1220 | 730 | 980 |
| 1 | 920 | 1170 | 730 | 900 |
| 2 | 920 | 1050 | 740 | 830 |
| 3 | 930 | 900 | 740 | 710 |
| 4 | 930 | 910 | 730 | 720 |
| 5 | 920 | 930 | 730 | 720 |
| 6 | 920 | 930 | 730 | 730 |
| 7 | 930 | 920 | 740 | 730 |
| 8 | 920 | 920 | 730 | 740 |
| 9 | 930 | 930 | 740 | 730 |
| 10 | 930 | 920 | 740 | 740 |
| 11 | — | — | — | — |
| 12 | 920 | 930 | 740 | 740 |
| 13 | — | — | — | — |
| 14 | — | — | — | — |
| 15 | 920 | 920 | 740 | 730 |

As is apparent from the results shown in FIG. 10, the hardness showed comparatively low value because coarse WC grains are used. Comparing with the inner portion, a drastic increase in hardness of the surface layer portion was recognized.

When regarded as hardness gradient portion, diffusion depth of silicon is smaller than that in case of boron diffusion material, and this reason is considered as a difference in characteristics between boron and silicon elements. However, it was recognized that diffusion migration of a binder metal is the same as that of boron. It is very useful feature for tools to be applied for high temperature range to be provided with the effect of surface compressive residual stress on suppression of heat cracking which is fatal to warm and hot tools as well as heat resistance and oxidation resistance.

When $SiB_6$ is used as the coating material, characteristics of the surface layer portion, which are composed of both characteristics of boron and silicon, are obtained.

[Performance Test]

Production of Sample

A commercially available WC powder having a mean grain size of 1.5 μm and a Co powder were weighed in accordance with the composition of WC-14% Co and mixed, charged in a stainless steel pot, together with an ethanol solvent and cemented carbide balls, and then ground and mixed for 30 hours. The resulting raw slurry was charged in a stirrer and, after vaporizing the solvent, 1.5% by weight of a paraffin wax was added, followed by mixing with heating to 70° C. to obtain a completed powder. Similarly, a commercially available WC powder having a mean grain size of 3.2 μm and a Co powder were weighed in accordance with the composition of WC-17% Co and mixed, followed by milling, drying and further mixing of wax to obtain a completed powder.

Using a ϕ25 mm press mold, a die cavity was filled with the completed powder and the powder was pressed under a pressure of 1 ton/$cm^2$ to obtain a compact measuring ϕ25×30 L mm.

The resulting compact was decreased and presintered in a presintering furnace at 900° C. and then subjected to a gradient treatment (PD). A partial presintered body was subjected to vacuum sintering at 1,350° C. to obtain a sintered body, which was then subjected to a gradient treatment (SG). Additionally, a sintered body of a WC-17% Co alloy was produced using a 3.2 μm WC powder and then subjected to a gradient treatment (VG) under almost the same conditions.

Gradient Treatment

In this example, #200-$B_4C$ powder was used as a diffusing material. Ethanol and the $B_4C$ powder were ground and mixed in a ball mill for 5 hours. Furthermore, a $B_4C$ coating material adjusted by PEI was prepared and the external surfaces of the presintered body and the sintered body, which are subjected to be a gradient treatment, were coated with a predetermined amount of the coating material, followed by drying and further gradient treatment under various conditions shown in Table 10. Each sample of the gradient-treated alloy thus obtained was cut in the center and polished, and then structure observation, element concentration analysis and hardness measurement were performed.

TABLE 10

WC (1.5μ)—14% Co gradient treatment conditions

| Sample No. | Object to be subjected to gradient treatment | Diffusing material and coating weight | Vacuum sintering conditions |
|---|---|---|---|
| PD125 | Presintered body | $B_4C$ 20 mg/$cm^2$ | 1250° C. × 60 min |
| PD130 | Presintered body | $B_4C$ 20 mg/$cm^2$ | 1300° C. × 60 min |
| PD135 | Presintered body | $B_4C$ 20 mg/$cm^2$ | 1350° C. × 60 min |
| PD140 | Presintered body | $B_4C$ 20 mg/$cm^2$ | 1400° C. × 60 min |
| SG120 | Sintered body | $B_4C$ 20 mg/$cm^2$ | 1200° C. × 120 min |
| SG125 | Sintered body | $B_4C$ 20 mg/$cm^2$ | 1250° C. × 120 min |
| SG130 | Sintered body | $B_4C$ 20 mg/$cm^2$ | 1300° C. × 120 min |

Structure Characteristics

In the samples PD125 and PD130, apparent "cavities" seen as dispersed black spots are remained and are in the state of including internal defects as an alloy material. When an alloy tool is produced using such a material, it is apparent that the tool is fractured within a very short time after the initiation of use because "cavities" serve as a fracture origin.

In the samples D135 and PD140 wherein the gradient treating temperature increased, "cavities" as internal defects are scarcely observed because of complete sintering densification, but concentration gradient of a Co binder phase is drastically unclear from the surface to the interior. The reason is considered that a liquid phase appears in the entire base material and therefore the concentration of the liquid phase becomes uniform within a range from the B diffused region of the surface to the interior undiffused region. A difference in the WC grain size between the surface layer and the interior is not recognized.

In the samples SG120, SG125 and SG130 wherein the gradient treatment was performed from the state of the sintered body, "cavities" as internal defects are not observed. As the gradient structure, concentration gradient of a Co binder phase from the surface layer portion to the interior can be clearly confirmed. As described above, contrastive structure gradient is exhibited when the gradient treatment is performed from the state of the presintered body and the gradient treatment is performed from the state of the sintered body, and it is found to be important that gradient treatment is performed at the temperature, at which the liquid phase appears of the sintering base material, or lower. Even if the gradient treatment is performed from the state of the presintered body, any grain growth structure is not observed.

Hardness Characteristics

Distribution of hardness from the surface layer portion to the interior by Hv Measurement is shown in FIG. 11. Since the samples PD125 and PD130 exhibit dispersion in measured values, description of data was omitted. First, in the gradient treatment of the presintered body, an improvement in surface hardness Hv of about 300 is recognized as compared with the internal hardness of the base material in the samples PD135 and PD140. This reason is considered to be a synergistic effect of an improvement in hardness due to a decrease of the Co binder phase amount of about 3% in the surface layer portion and an improvement in hardness due to solid solution strengthening or precipitation strengthening of B as a diffusion element. Comparing with the surface hardness due to SG125. 130, the hardness Hv is low by about 200 to 300.

In the gradient treatment from the presintered body, B and Si elements used in the present invention, particularly a B element has small active energy and exhibits high diffusion rate, and thus diffusion rapidly proceeds in the presence of a liquid phase. Therefore, the state concentrated in the surface layer portion is not attained and the element scarcely contributes to remarkable solid solution strengthening and precipitation strengthening.

On the other hand, in the samples SG120 to SG130 wherein the gradient treatment was performed from the state of the sintered body, a remarkable improvement in surface hardness is entirely recognized. When the gradient treating temperature increases, the depth of the gradient region tends to increases. By the way, when the gradient treating temperature increases furthermore, for example, when treated at 1400° C., a liquid phase appears in the entire material and therefore surface hardness decreases to the same level as that of the sample PD140.

Comparison of Co Concentration and Hv-Co Relationship

Figure 12:
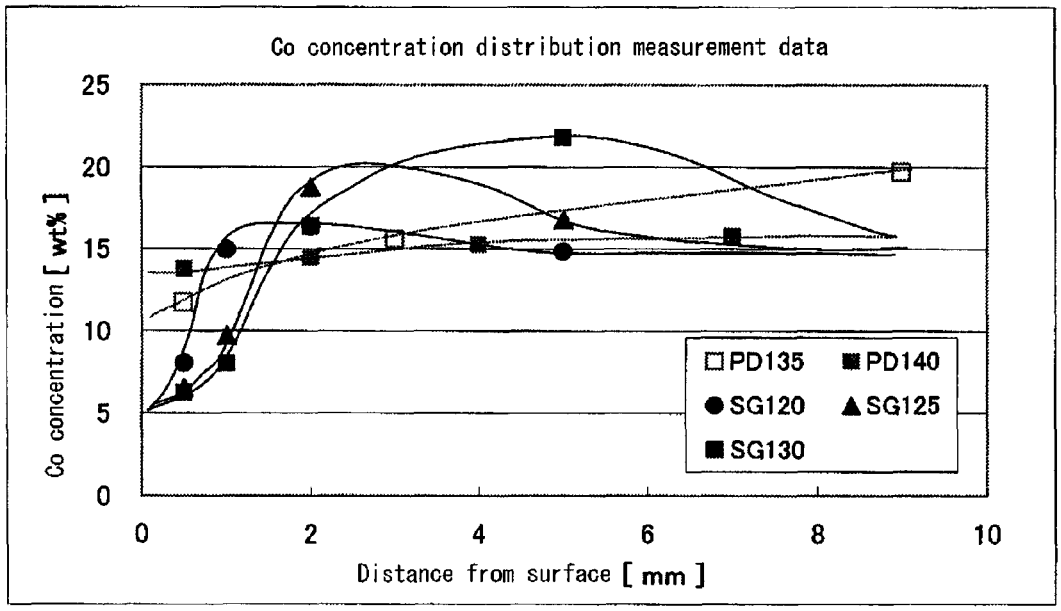
FIG. 12 is a graph showing distribution of Co concentration from the surface layer portion to the interior by EDAX analysis.
Figure 13:
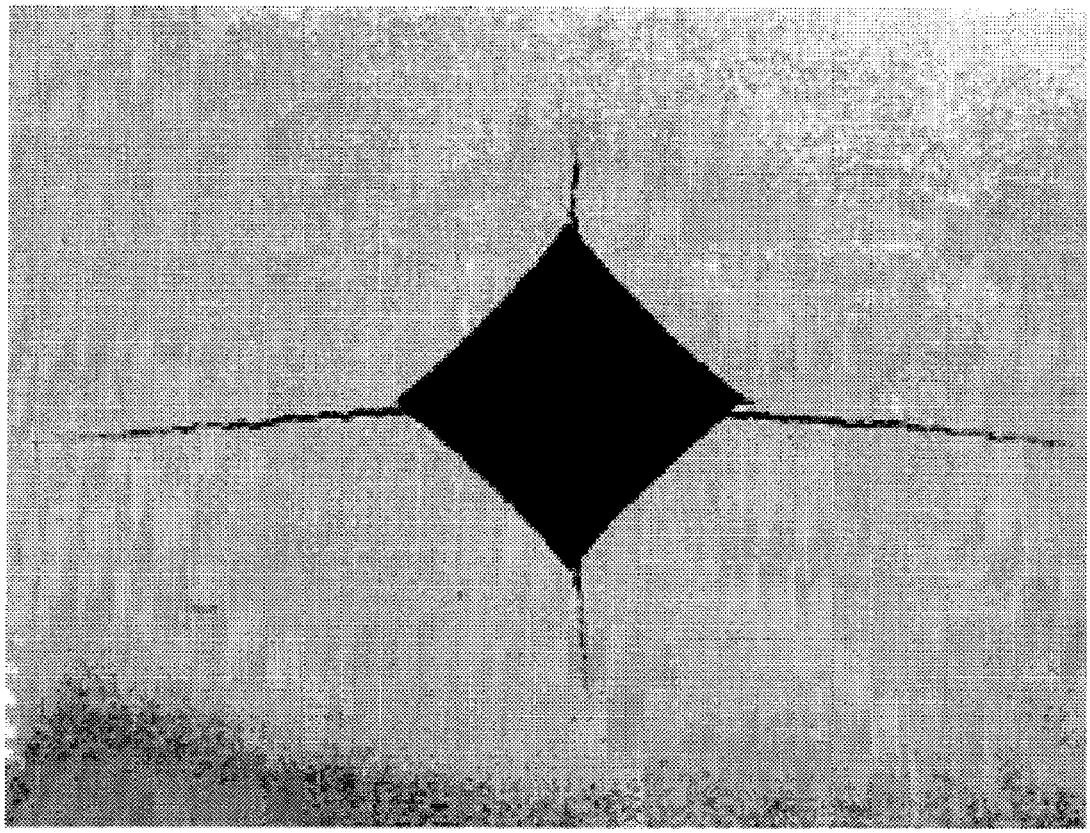
FIG. 13 is a photomicrograph showing the evaluation results of fracture toughness by an IF method.

A graph showing distribution of Co concentration from the surface layer portion to the interior by EDAX analysis is shown in FIG. 12. Co concentration distribution of the samples PD135, PD140 subjected to a gradient treatment: from the state of the presintered body increases from the surface to the interior but increases very slowly, and concentration ratio bs/bi of the surface/interior is as follows: D135=0.66 and PD140:0.87.

On the other hand, in the samples SG120, SG125 and SG130 of the present invention, the Co concentration of the surface is very small and tends to rapidly increase at the position in the vicinity of the surface (2 mm apart from the surface). The value bs/bi calculated in the same manner is very small as follows: SG120=0.54, SG125=0.39, and SG130=0.28.

Evaluation of Fracture Toughness of Surface Layer

In the present invention, large compressive residual stress is generated at the gradient surface layer because of the structure constituted of a high hardness surface layer in which the amount of the binder phase decreased drastically, and the interior in which the amount of the binder phase increased. An example of evaluation of fracture toughness by the IF method will be described.

This drawing shows cracking propagated from Hv indentation of the surface layer. The length of crack propagated from the surface to the interior of the gradient structure was extremely shorter than that of crack which is perpendicular to the above crack. This phenomenon suggests that fracture from the surface to the interior is less likely to occur because effective compressive residual stress is imparted to the surface layer by the gradient structure of the present invention, and also suggests the gradient structure of the present invention has both high hardness and high toughness which are antinomic with each other.

The above results are summarized. As a metalloid based element, $B_4C$ was particularly selected as a compound of B from the group consisting of B, Si and P and a gradient treatment was carried out, and then various evaluations were performed. As a result, the following facts were found.

1) In the present invention, a sintered body is subjected to a gradient treatment, internal defects do not arise.

2) In the gradient treatment of the present invention, hardness gradient (Hv=about 400 to 500) is obtained.

3) In the gradient treatment of the present invention, a gradient structure is obtained regardless of the WC grain size.

4) In the gradient treatment of the present invention, a gradient structure is obtained because the concentration of a binder phase of the surface layer remarkably decreases.

5) In the gradient treatment of the present invention, WC grains do not grow and a gradient structure is obtained regardless of control of the grain size.

6) In the gradient treatment of the present invention, fracture toughness of the surface layer is extremely improved because compressive residual stress is generated in the surface layer.

A WC—Co system cemented carbide is excellent in wear resistance, toughness, chipping resistance and thermal crack resistance, and is also applied for tools for cold forging, rolls, bits for mining tool, crushing blades, cutter blades and wear resistant tools.

We claim:

1. A method for producing a cemented carbide material comprising a surface layer and a core that has a grain size gradient structure where the mean hard grain size of the surface layer is larger than that of the core, and a concentration gradient of binder metal wherein the concentration of the binder metal in the surface is smaller than that of the core, comprising the steps of:

subjecting a WC—Co system compact to a treatment for producing $M_3C$ type double carbide (wherein M comprises M1 and M2; M1 represents one or more elements selected from the group consisting of Ti, Zr, Hf, V, Nb, Ta, Cr, Mo, and W; and M2 represents one or more elements selected from the group consisting of Fe, Co and Ni) as a main component of the surface portion wherein the step of subjecting a WC—Co system compact to a treatment for containing $M_3C$ type double carbide is carried out by dipping the WC—Co system compact in a solution for supplying both of W and an oxidizing agent and reducing heat treating the compact at a vacuum atmosphere, subjecting the resulting WC—Co compact containing $M_3C$ type double carbide to a carburization treatment at a temperature of 800 to 1100° C. to decompose said $M_3C$ type double carbide;

subjecting the carburized compact to liquid phase sintering at a temperature of more than 1350° C. to form a sintered body; and coating a surface layer of the sintered body with a compound containing boron and/or silicon and subjecting the coated sintered body to a diffusion heat treatment at a temperature within a range from 1200 to 1350° C.

2. The method according to claim 1, wherein the step of subjecting the compact to liquid phase sintering at a temperature of more than 1350° C. forms a sintered body where the mean hard grain size of the surface layer is 1.5 times that of the core.

3. The method according to claim 2, wherein the surface layer of the resulting sintered material has a hardness HRA of 88 to 92 and toughness $K_{IC}$ of 20 to 30 $MN/m^{3/2}$.

4. The method according to claim 1, wherein the surface layer of the resulting sintered material has the surface layer containing boron or silicon of 0.010 to 1.0 wt. % and having higher distribution density of hard grains than that of the core.

5. The method according to claim 4, wherein the core of the resulting sintered material has a content weight ratio of iron family metals (more than one element selected from Fe, Co and Ni) to hard grains WC of from 5:95 to 40:60.

6. The method according to claim 5, wherein the surface layer of the resulting sintered material contains less than 2 wt % of binder metal.

7. The method according to claim 5, wherein the coating layer contains metal boron in an amount of 5.0 to 40 mg per $cm^2$ of the coating area.

8. The method according to claim 1, wherein said solution for supplying both W and an oxidizing agent is an aqueous solution of tungstic acid or an aqueous solution of ammonium tungstate and cobalt nitrate.

9. The method according to claim 1, wherein after said treatment for producing $M_3C$ type double carbide and before the step of liquid phase sintering, the step of subjecting the compact to nitriding treatment is carried out.

* * * * *